US007936127B2

(12) United States Patent
Ryu et al.

(10) Patent No.: US 7,936,127 B2
(45) Date of Patent: May 3, 2011

(54) PLASMA DISPLAY APPARATUS

(75) Inventors: Seong Nam Ryu, Busan-si (KR); Woo Gon Jeon, Gumi-si (KR); Sang Min Hong, Seoul (KR); Woo Tae Kim, Yongin-si (KR); Kyung A Kang, Busan-si (KR); Jeong Hyun Hahm, Gumi-si (KR); Jae Sung Kim, Gumi-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/594,334

(22) Filed: Nov. 8, 2006

(65) Prior Publication Data

US 2007/0278954 A1 Dec. 6, 2007

(30) Foreign Application Priority Data

May 30, 2006 (KR) ..... 10-2006-0048820

(51) Int. Cl.
*H01J 17/49* (2006.01)

(52) U.S. Cl. ..... 313/586; 313/585; 313/587; 313/584; 313/583; 313/582

(58) Field of Classification Search ..... 313/581–587
See application file for complete search history.

(56) References Cited

U.S. PATENT DOCUMENTS 6,034,474 A * 3/2000 Ueoka et al. ..... 313/584
6,160,345 A 12/2000 Tanaka et al.
6,184,621 B1 2/2001 Horiuchi et al. ..... 313/586
6,407,503 B1 6/2002 Mizobata ..... 313/587
6,522,072 B1 * 2/2003 Yura et al. ..... 313/582
6,646,375 B1 * 11/2003 Nagano ..... 313/582
6,670,754 B1 12/2003 Murai et al.

(Continued)

FOREIGN PATENT DOCUMENTS

CN 1319244 10/2001

(Continued)

OTHER PUBLICATIONS

European Search Report dated Nov. 12, 2007.

(Continued)

*Primary Examiner* — Nimeshkumar D Patel
*Assistant Examiner* — Thomas A Hollweg
(74) *Attorney, Agent, or Firm* — KED & Associates, LLP

(57) ABSTRACT

A plasma display apparatus is provided that includes a front substrate, a first electrode, a second electrode and a dielectric layer formed on the front substrate, a rear substrate faced with the front substrate, a third electrode formed on the rear substrate, and a barrier rib which is formed on the rear substrate and partitions discharge cells, wherein at least one of the first electrode and the second electrode is formed with one layer, and the width of at least one of barrier ribs which partitions the discharge cells in the outside of an effective display region is wider than the width of barrier ribs which partition the discharge cells in the inside of the effective display region. The plasma display apparatus does not include a transparent electrode consisting of ITO, reducing the manufacturing cost of the plasma display panel. Further, by forming projecting electrodes protruded in the direction of the center of the discharge cell or in the opposite direction of the center of the discharge cell from the scan electrode or the sustain electrode line, the firing voltage can be lowered and the discharge diffusion efficiency of the discharge cell increased.

35 Claims, 19 Drawing Sheets

U.S. PATENT DOCUMENTS

| | | | | |
|---|---|---|---|---|
| 6,734,626 | B2 | 5/2004 | Yoshioka et al. | |
| 6,828,731 | B2 * | 12/2004 | Kang et al. | 313/587 |
| 7,002,296 | B2 | 2/2006 | Sano et al. | |
| 7,009,587 | B2 | 3/2006 | Nishimura et al. | |
| 7,045,962 | B1 | 5/2006 | Murai et al. | |
| 2002/0195939 | A1 | 12/2002 | Okigawa et al. | |
| 2004/0032215 | A1 | 2/2004 | Nishimura et al. | |
| 2004/0041522 | A1 | 3/2004 | Takada et al. | |
| 2004/0142623 | A1 | 7/2004 | Joo et al. | |
| 2004/0150340 | A1 | 8/2004 | Son et al. | |
| 2004/0183440 | A1 | 9/2004 | Huang et al. | |
| 2004/0201351 | A1 * | 10/2004 | Woo et al. | 313/582 |
| 2004/0256988 | A1 | 12/2004 | Chang et al. | |
| 2005/0029941 | A1 | 2/2005 | Kwon et al. | |
| 2005/0067959 | A1 | 3/2005 | Jang et al. | |
| 2005/0082958 | A1 | 4/2005 | Su et al. | |
| 2005/0134176 | A1 | 6/2005 | Kwon et al. | |
| 2005/0179382 | A1 | 8/2005 | Kim | |
| 2005/0236994 | A1 * | 10/2005 | Kwon et al. | 313/584 |
| 2005/0242729 | A1 | 11/2005 | Kweon | |
| 2005/0264197 | A1 | 12/2005 | Yoshinari et al. | |
| 2005/0285524 | A1 | 12/2005 | Tokai et al. | |
| 2005/0285529 | A1 | 12/2005 | Hwang et al. | |
| 2006/0001371 | A1 * | 1/2006 | Jang | 313/582 |
| 2006/0028139 | A1 | 2/2006 | Son et al. | |
| 2006/0028406 | A1 | 2/2006 | Mizobata | |
| 2006/0113908 | A1 | 6/2006 | Lee | |
| 2006/0113909 | A1 | 6/2006 | Su | |
| 2006/0113912 | A1 | 6/2006 | Kim et al. | |
| 2006/0181212 | A1 | 8/2006 | Sawa et al. | |
| 2006/0186812 | A1 | 8/2006 | Su et al. | |
| 2006/0226779 | A1 * | 10/2006 | Ahn | 313/583 |

FOREIGN PATENT DOCUMENTS

| | | |
|---|---|---|
| CN | 1581404 | 2/2005 |
| CN | 1622256 | 6/2005 |
| CN | 1716504 | 1/2006 |
| CN | 1725423 | 1/2006 |
| CN | 1755879 | 4/2006 |
| JP | 10-106443 | 4/1998 |
| JP | 11-096924 | 4/1999 |
| JP | 11-283511 | 10/1999 |
| JP | 2003-031133 | 1/2003 |
| KR | 10-2006-0032109 | 4/2006 |
| KR | 10-0578932 | 5/2006 |

OTHER PUBLICATIONS

Korean Search Report dated Jul. 23, 2007.
Chinese Office Action dated Mar. 28, 2008.
Chinese Office Action dated Mar. 20, 2009.
European Search Report dated Jun. 23, 2009.

* cited by examiner

PLASMA DISPLAY APPARATUS

This application claims the benefit of Korean Patent Application No. 10-2006-0048820 filed on May 30, 2006, which is hereby incorporated by reference for all purposes as if fully set forth herein.

BACKGROUND OF THE INVENTION

1. Field of the Invention

The present invention relates to a plsma display panel, in particular, to a panel equipped in a plasma display panel.

2. Description of the Conventional Art

As to a plasma display panel, one unit cell is comprised of a barrier rib formed between a front substrate and a rear substrate. Each of the cells is filled with a primary discharge gas such as neon (Ne), helium (He) or a mixed gas comprising Ne and He. In addition, each cell contains an inert gas comprising a small amount of xenon. If the inert gas is discharged using a high frequency voltage, ultraviolet rays are generated. The ultra-violet rays excite light-emitting phosphors in each cell, thus creating a visible image. Plasma display panels can be made thin and slim, and have thus been in the spotlight as the next-generation of display devices.

FIG. 1 is a perspective view illustrating the configuration of a conventional plasma display panel. As shown in FIG. 1, the plasma display panel includes a front panel 100 where a plurality of sustain electrode pairs are arranged while the sustain electrode pair is formed with a scan electrode 102 and a sustain electrode 103 to form a pair on a front substrate 101 that serves as the display surface on which the images are displayed, and a rear panel 110 where a plurality of address electrodes 113 are arranged to intersect with the plurality of sustain electrode pairs on a rear substrate 111 forming a rear surface. The front panel 100 and the rear panel 110 are parallel to each other, with a predetermined distance therebetween.

The front panel 100 includes a scan electrode 102 and a sustain electrode 103. The scan electrode 102 and the sustain electrode 103 each have a transparent electrode 102*a*, 103*a* made of a transparent ITO material, and a bus electrode 102*b*, 103*b*. The scan electrode 102 and the sustain electrode 103 together form an electrode pair. The scan electrode 102 and the sustain electrode 103 are covered with a front dielectric layer 104. A protection layer 105 is formed on the front dielectric layer 104.

In the rear panel 110, barrier ribs 112 for partitioning a discharge cell are included. Further, a plurality of address electrodes 113 are disposed parallel to the barrier ribs 112. Red (R), green (G) and blue (B) phosphors 114 are coated on the address electrodes 113. A rear dielectric layer 115 is formed between the address electrodes 113 and the phosphors 114.

In the meantime, the transparent electrode 102*a*, 103*a* forming the scan electrode 102 and the sustain electrode 103 is made of an Indium Tin Oxide ITO of a high price. The transparent electrode 102*a*, 103*a* causes the rising of the manufacturing cost of the plasma display panel. Therefore, recently, the manufacturing of plasma display panel which can secure the color characteristic and the driving characteristic sufficient for the user's watching with the reduction of the manufacturing cost has been required.

SUMMARY OF THE INVENTION

Accordingly, an object of the present invention is to solve at least the problems and disadvantages of the background art.

The object of the present invention is to provide a panel equipped in a plasma display apparatus, which is capable of reducing the manufacturing cost of the panel by eliminating a transparent electrode made of ITO.

An aspect of a plasma display apparatus according to the present invention comprises a front substrate; a first electrode, a second electrode and a dielectric layer formed on the front substrate; a rear substrate faced with the front substrate; a third electrode formed on the rear substrate; and a barrier rib which is formed on the rear substrate and partitions discharge cells, wherein at least one of the first electrode and the second electrode is formed with one layer, and the width of at least one of barrier ribs which partitions the discharge cells in the outside of an effective display region is wider than the width of barrier ribs which partition the discharge cells in the inside of the effective display region.

In accordance with the present invention, at least one of the first electrode and the second electrode comprises a line part formed in a direction intersecting with the third electrode; and a protrusion protruded from the line part.

Preferably, the width of at least one of the barrier ribs partitioning the discharge cells in the outside of the effective display region ranges from 500 μm to 900 μm.

The width of at least one of the barrier ribs partitioning the discharge cells in the outside of the effective display region is 1.25 times to 4.5 times than the width of the barrier rib partitioning the discharge cells in the inside of the effective display region.

In accordance with the present invention, the plasma display apparatus further comprises at least one dummy cell in which an image is not displayed.

The dummy cell includes a dummy electrode, and the dummy electrode is formed with a shape which is identical with one of the first, and the second electrode.

The dummy electrode comprises a line part formed in a direction intersecting with the third electrode; and a protrusion protruded from the line part.

The width of the dummy electrode ranges from 30 μm or 60 μm.

2 or more dummy cells include a dummy line lining up in a direction intersecting with the third electrode.

The number of the dummy line formed in one side of the plasma display apparatus is two.

In accordance with the present invention, the plasma display apparatus further comprises a dielectric layer formed on the substrate, and at least one of the first electrode and the second electrode is gloomy than the dielectric layer.

In accordance with the present invention, the plasma display apparatus further comprises a glass filter. In accordance with the present invention, the plasma display apparatus further comprises a black matrix covering the outside of the effective region of the front substrate; and a clear filter.

The width between the two adjacent line parts is the same.

The rear substrate comprises a dielectric layer; a barrier rib partitioning the discharge cell; and a phosphor layer.

Another aspect of a plasma display apparatus according to the present invention comprises a front substrate; a first electrode, a second electrode and a dielectric layer formed on the front substrate; a rear substrate faced with the front substrate; a third electrode formed on the rear substrate; and a barrier rib which is formed on the rear substrate and petitions discharge cells, wherein at least one of the first electrode and the second electrode is formed with one layer, and comprises at least one dummy cell in which an image is not displayed.

At least one of the first electrode and the second electrode comprises a line part formed in a direction intersecting with the third electrode; and a protrusion protruded from the line part.

Preferably, the width of the dummy electrode ranges from 30 μm to 60 μm.

Still another aspect of a plasma display apparatus according to the present invention comprises a front substrate; a first electrode, a second electrode and a dielectric layer formed on the front substrate; a rear substrate faced with the front substrate; a third electrode formed on the rear substrate; and a barrier rib which is formed on the rear substrate and partitions discharge cells, wherein at least one of the first electrode and the second electrode is formed with one layer, and the width of at least one of barrier ribs formed in the outermost portion of the rear substrate is wider than the width of the other barrier ribs except the one barrier rib.

The width of at least one of the barrier ribs formed in the outermost portion of the rear substrate ranges from 500 μm to 900 μm.

BRIEF DESCRIPTION OF THE DRAWINGS

The invention will be described in detail with reference to the following drawings in which like numerals refer to like elements. The accompany drawings, which are included to provide a further understanding of the invention and are incorporated in and constitute a part of this specification, illustrate embodiments of the invention and together with the description serve to explain the principles of the invention. In the drawings.

DETAILED DESCRIPTION OF PREFERRED EMBODIMENTS

Preferred embodiments of the present invention will be described in a more detailed manner with reference to drawings.

It should be noted that a plasma display apparatus according to the present invention is not restricted in the embodiments described in this specification, but a plurality of embodiments can exist.

Figure 2:
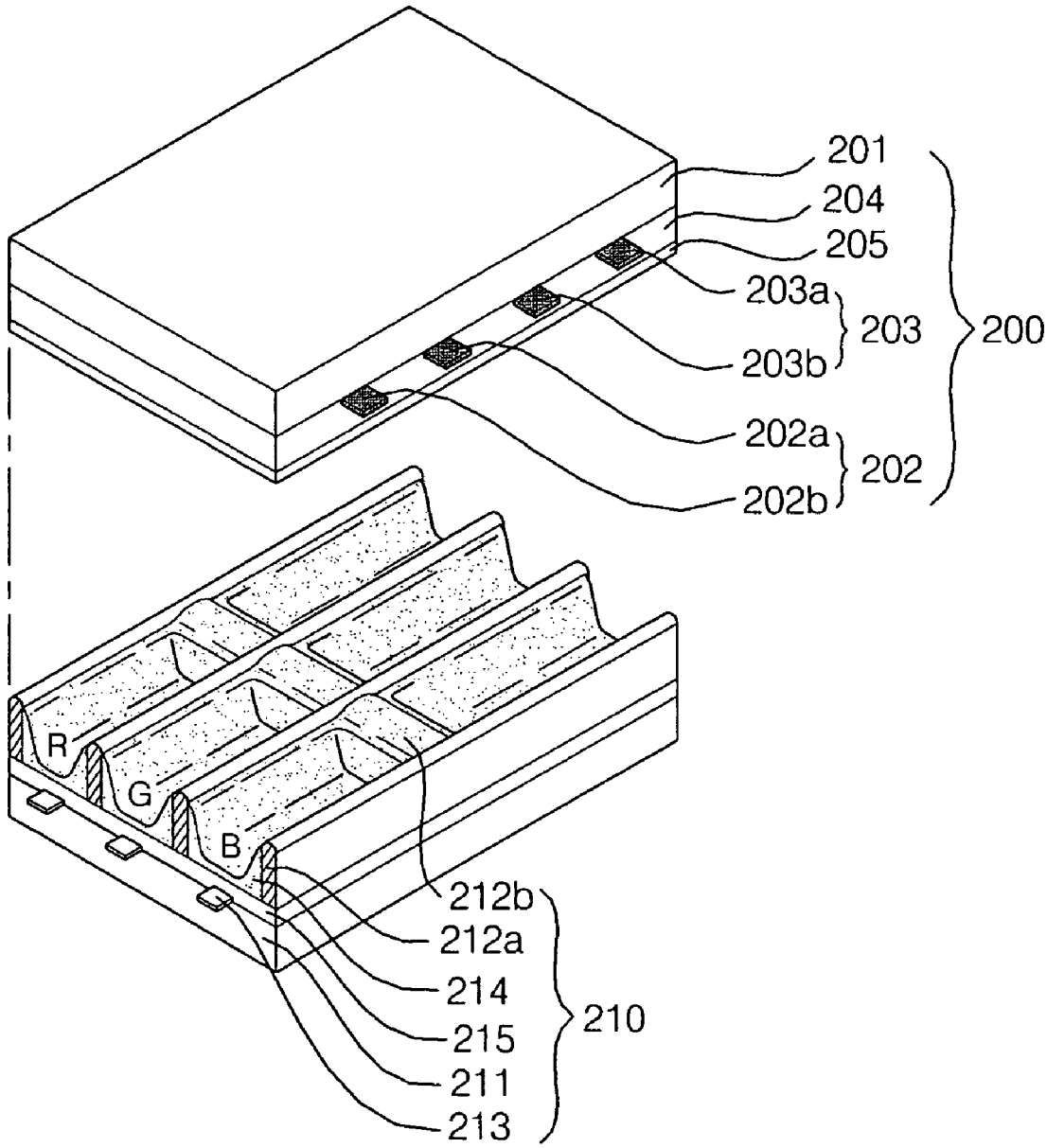
FIG. 2 is a perspective view showing an embodiment of a plasma display panel structure according to the present invention.

Hereinafter, the plasma display apparatus according to the present invention will be illustrated with reference to FIG. 2 to FIG. 17. FIG. 2 is a perspective view showing an embodiment of a panel equipped in the plasma display apparatus according to the present invention.

Referring to FIG. 2, the plasma display panel includes a front panel 200 and a rear panel 210 which are coalesced with a predetermined gap, and including an address electrode 213 which is formed on a rear substrate 211 in a direction intersecting with a sustain electrode pair 202, 203, and barrier ribs 212 which partition a plurality of discharge cells and are formed on a rear substrate 211.

The front panel 200 includes the sustain electrode pair 202, 203 which are formed on the front substrate 201 as a pair. The sustain electrode pair 202, 203 is classified into a scan electrode 202 and a sustain electrode 203 according to a function. The sustain electrode pair 202, 203 which limits a discharge current and is covered with a front dielectric layer 204 which insulates between the electrode pair. A protection layer 205 is formed on the upper surface of the front dielectric layer 204 to protect the front dielectric layer 204 from the sputtering of charged particles generated in a gaseous discharge and to enhance the emission efficiency of a secondary electron.

As to the rear panel 210, the barrier ribs 212 which patiton one discharge cell, or a plurality of discharge spaces are formed on the rear substrate 211. Further, the address electrode 213 is arranged in the direction intersecting with the sustain electrode pair 202, 203. On the surface of a rear dielectric layer 215 and a barrier rib 212, a phosphor 214 in which the visible light is generated by the ultraviolet ray generated in a gaseous discharge to emit a light is coated.

At this time, the barrier rib 212 is comprised of a column barrier rib 212*a* formed in an identical direction with the address electrode 213, and a row barrier rib 212*b* formed in a direction intersecting with the address electrode 213. The barrier rib 212 physically divides the discharge cell, prevents the ultraviolet ray and the visible light generated by a discharge from being leaked out to the adjacent discharge cell.

Figure 1:
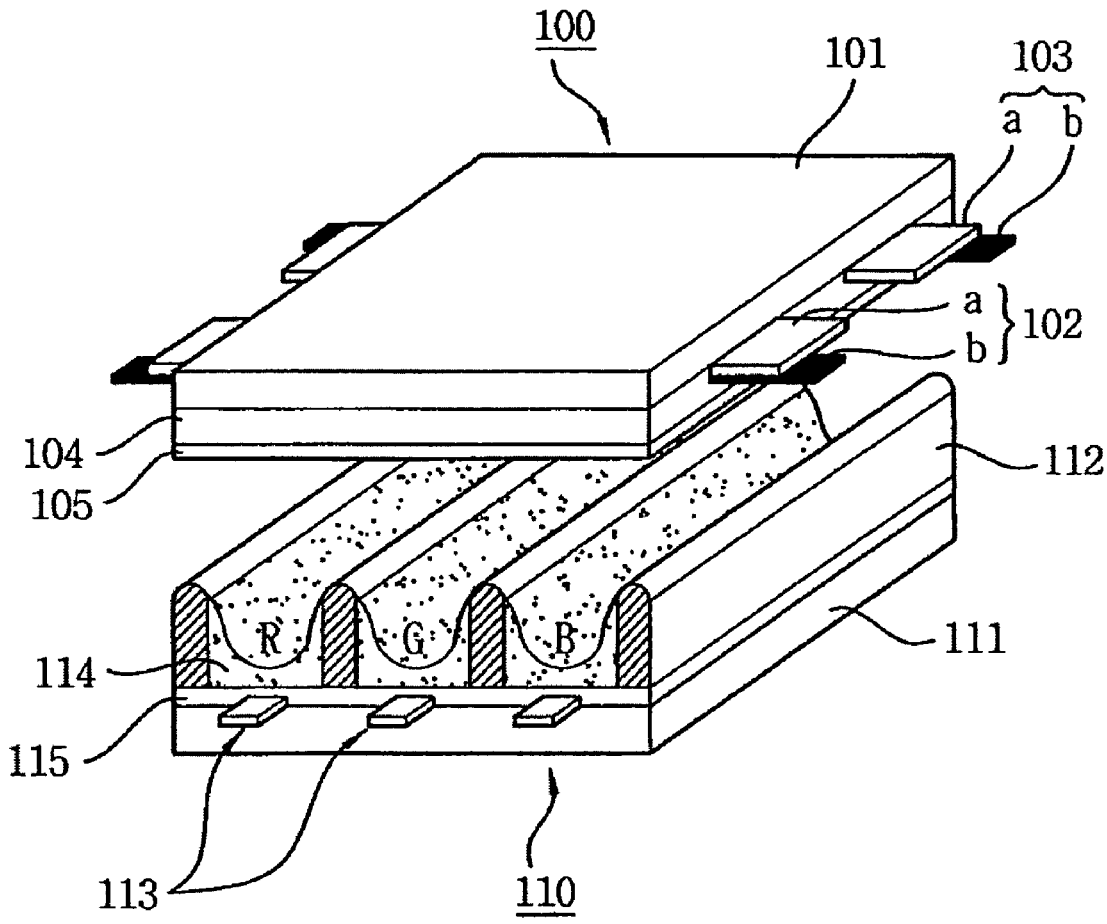
Fig.1 (related art)
FIG. 1 is drawing illustrating the configuration of a conventional plasma display panel equipped in a plasma display apparatus.

Further, in the plasma display panel according to the present invention, the sustain electrode pair 202, 203 is only made of a metal electrode which is opaque, which is different with the conventional sustain electrode pair 102, 103 shown in FIG. 1. That is, ITO which is a conventional transparent electrode material is not used. The sustain electrode pair 202, 203 is formed by using Ag, Cu, and Cr which are conventional material of the bus electrode. That is, the sustain electrode pair 202, 203 of the plasma display panel according to the present invention does not include the conventional ITO electrode, but is made of one layer of the bus electrode.

It is preferable that the width of the electrode line of the sustain electrode pair 202, 203 ranges from 30 μm to 60 μm. As the width of the electrode line of the sustain electrode is in such a range, the aperture ratio of the panel necessary for displaying can be obtained to maintain the luminance of a display image.

For example, it is preferable that the sustain electrode pair 202, 203 according to the embodiment of the present invention is respectively formed with silver, while the silver Ag has a characteristic of photosensitivity. Further, it is preferable that the sustain electrode pair 202, 203 according to the embodiment of the present invention is more gloomy in color and more lower in a light permeability than the front dielectric layer 204 formed on the front substrate 201.

It is preferable that the thickness of electrode lines 202*a* 202*b*, 203*a*, 203*b* ranges 2 μm or 7 μm. When electrode lines 202*a* 202*b*, 203*a*, 203*b* are formed with the thickness of such range as described in the above, they have the resistance in which the plasma display panel normally can be operated. In addition, as the panel has the necessary aperture ratio, the light reflected to the front of the display device is blocked by the electrode to prevent the reduction of the luminance of a screen, and the capacitance of the panel is not so much increased. Further, as the thickness of electrode lines 202*a*, 202*b*, 203*a*, 203*b* is thick as described above, it is preferable that the resistance of electrode lines 202*a*, 202*b*, 203*a*, 203*b* is 50Ω or 65 Ω.

The discharge cell can be a symmetrical structure in which the pitch of each fluorescent material layer 214 of Red R, Green G, and Blue B is identical or can be an asymmetric structure in which the pitch is different.

As shown in FIG. 2, it is preferable that the sustain electrode 202, 203 is formed in one discharge cell as a plurality of electrode lines. That is, it is preferable that a first sustain electrode 202 is formed with two electrode lines 202*a*, 202*b*. A second sustain electrode 203 is symmetrically arranged with the first sustain electrode 202 based on the center of the discharge cell. It is preferable that the first and the second sustain electrodes 202, 203 are the scan electrode and the sustain electrode respectively. Considering the aperture ratio and the discharge diffusion efficiency due to the opaque sustain electrode pair 202, 203, such definition can be obtained. That is, the electrode line having a narrow width is used in consideration of the aperture ratio. A plurality of electrode lines are used in consideration of the discharge diffusion efficiency. At this time, it is preferable that the number of electrode lines is determined by simultaneously considering the aperture ratio and the discharge diffusion efficiency.

The structure illustrated in FIG. 2 is just an embodiment of the structure of the plasma panel according to the present invention. Therefore, the present invention is not restricted in the plasma display panel structure illustrated in FIG. 2. For example, a black matrix BM can be formed on the front substrate 201 that performs a function of the optical cut-off by absorbing the external light generated outside to reduce a reflection and a function of improving a purity and a contrast of the front substrate 201. The black matrix can be both a separate type and an integrated type. In this case, the separate type BM has a structure where a black layer formed between the sustain electrode 202, 203 and the front substrate 201 and the black matrix are not connected. The integrated type BM has a structure where the layer and the black matrix are connected to form an integration type. Further, the black matrix and the layer can be formed with different material if the separate type BM is formed. When the integrated type BM is formed, the black matrix and the layer can be formed with the same material.

Further, the barrier rib structure of the panel shown in FIG. 2 showing a close type in which the discharge cell has a closed structure with the column barrier rib 212*a* and the row barrier rib 212*b*. But, other structure also can be used such as a stripe type including only the column barrier rib or a fish bone type where a protrusion is formed on the column barrier rib with a predetermined gap.

As to the embodiment of the present invention, not only the structure of the barrier rib shown in FIG. 2, but the structure of the barrier rib with a various shape can be used. For example, a differential type barrier rib structure where the height of the row barrier rib 212*b* and the column barrier rib 212*a* is different, a channel type barrier rib structure where a channel available for ventilating passage is formed in at least one of the column barrier rib 212*a* and the row barrier rib 212*b*, and a hollow type barrier rib structure where a hollow is formed in at least one of the column barrier rib 212*a* and the row barrier rib 212*b*. In this case, it is preferable that the height of the row barrier rib 212*b* is higher than the height of the column barrier rib 212*a*. In the differential barrier rib structure or the hollow type barrier rib structure, it is preferable that a channel or a hollow is formed in the row barrier rib 212*b*.

In the meantime, in the embodiment of the present invention, it is explained and illustrated that each R, G and B discharge cell is arranged in the same line. However, other arrangement can be used. For example, the arrangement of a delta type where R, G, and B discharge cell are arranged as a triangle form can be possible. Further, the shape of the discharge cell can be a various polygonal shape including not only a square shape but also a pentagon, a hexagon can be possible.

It is preferable that, in the plasma display panel according to the present invention, the width of the barrier rib positioned in the outer-most among the barrier ribs partitioning a plurality of discharge cells is broader than the width of the other barrier ribs. For example, it is preferable that the width of the row barrier rib positioned in the outer-most among the row barrier rib of the plasma display panel is broader than the width of the other row barrier ribs. In addition, it is preferable that the width of the column barrier rib positioned in the outer-most among the column barrier rib of the plasma display panel is broader than the width of the other column barrier ribs. Preferably, the width of the row barrier rib ranges from 500 μm to 900 μm. When the width of the row barrier rib satisfies such range, the deformation of the barrier rib after forming barrier rib can be prevented, and the discharge of the cells is not influenced by the external factor.

In the meantime, according to the embodiment of the present invention, it is preferable that the width of the row barrier rib or the column barrier rib except the row barrier rib or the column barrier rib positioned in the outer-most ranges from 200 μm to 400 μm. It is preferable that the width of the row barrier rib or the column barrier rib positioned in the outer-most is wider 1.25 times to 4.5 times than the width of the row barrier rib or the column barrier rib. That is, the efficiency and the luminance are improved when the width of one or more row barrier rib or column barrier rib positioned in the region where an image is displayed ranges 200 μm or 400 μm.

Further, it is preferable that the plasma display panel can be comprised of an effective region in which an image is displayed and a dummy region which is positioned in an edge area and an image is not displayed in. It is preferable that dummy cells which do not have an effect on the display image of the plasma display apparatus are formed in the dummy region. Dummy cells can perform the function of assisting the discharge in the effective region or increasing the reliability in the panel manufacturing.

Figure 3A:
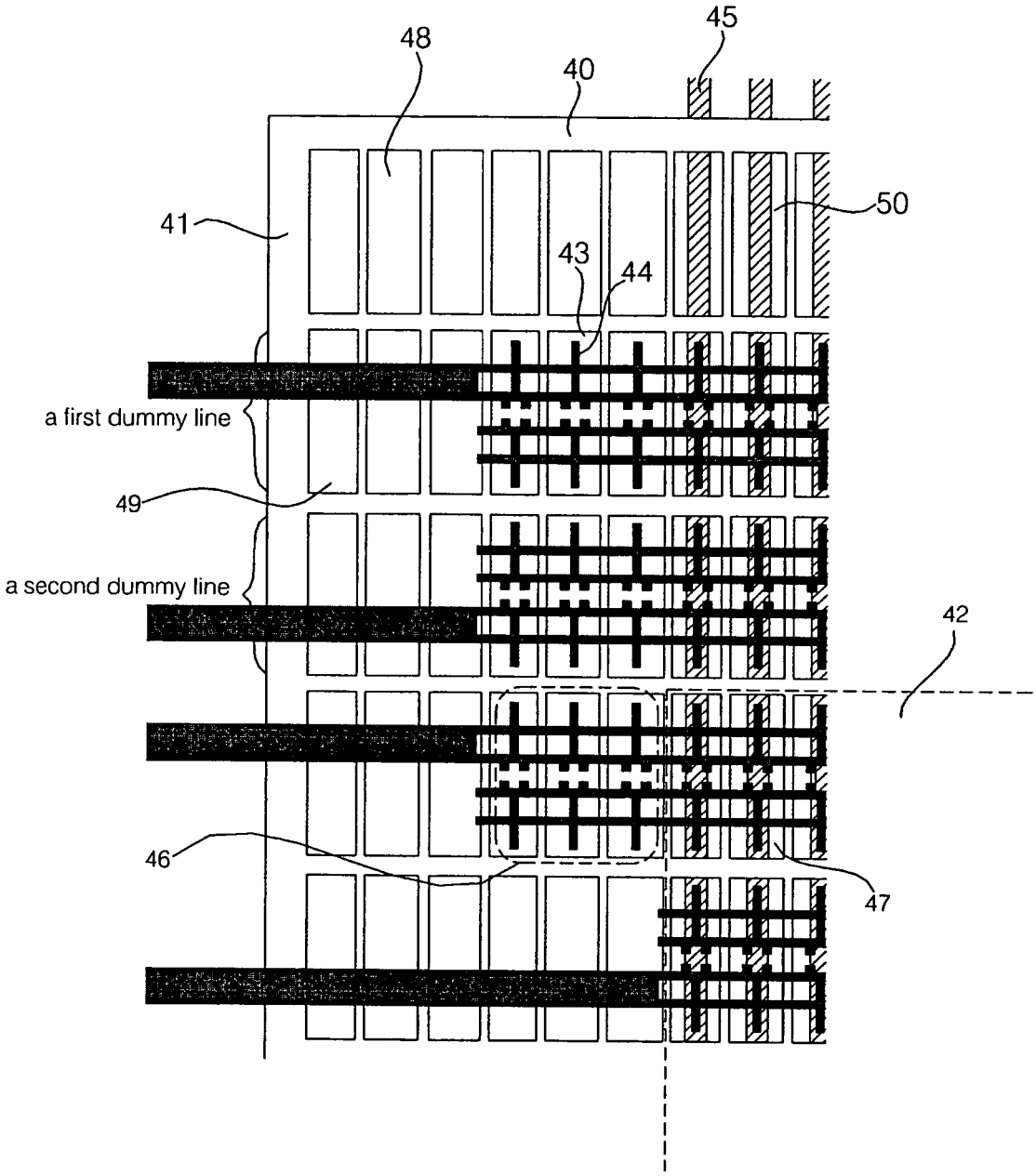
FIG. 3A and FIG. 3B are a cross-periodal view showing an embodiment of the edge structure of a plasma display panel according to the present invention.
Figure 3B:
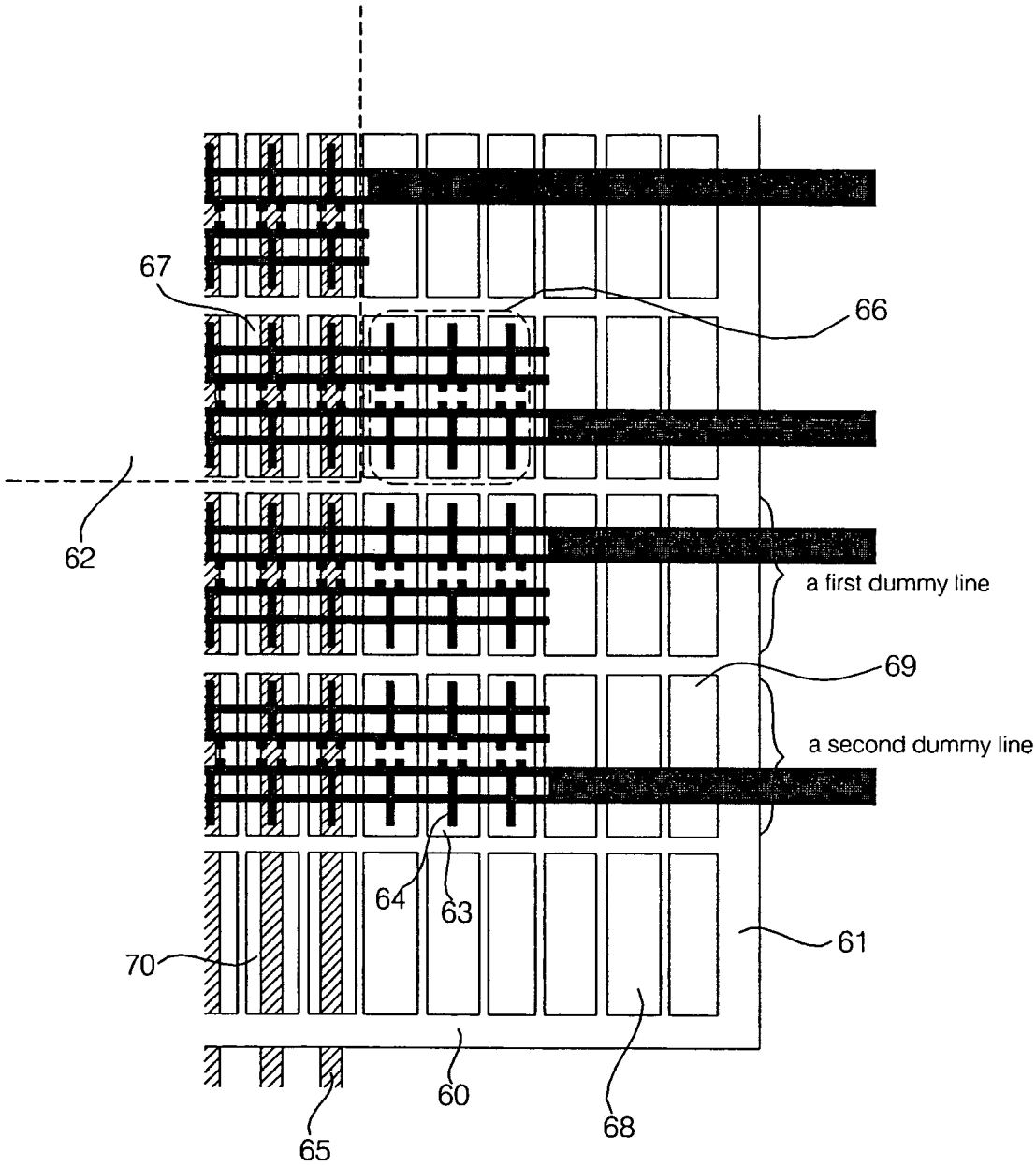

FIG. 3A and FIG. 3B are a cross-periodal view showing an embodiment of the edge structure of a plasma display panel according to the present invention. FIG. 3A is a cross-periodal view showing the embodiment of the structure of the edge of the left side of the upper portion of the plasma display panel.

As shown in FIG. 3A, it is preferable that the width of a row barrier rib 40 and a column barrier rib 41 disposed in the outer most is wider than the width of the barrier ribs of the inside. Further, it is preferable that the width of the row barrier rib 40 ranges 500 μm or 900 μm. The cells 48, 49, 50 positioned in the outer most among a plurality of discharge cells included in the panel are partitioned with dummy barrier ribs, and as shown in FIG. 3A, without including the electrodes having the structure which is formed in other discharge cells, only electrode lines for supplying a driving signal to electrodes are extended on them. Further, as shown in FIG. 3A, the three cells R, G, B of the edge of the left side of the panel are divided by the dummy barrier rib. It is preferable that a protruding electrode as formed in different cells is not formed in the cell divided by the dummy barrier rib.

Further, the dummy cell including dummy electrodes which do not have an effect on the display image is formed on the upper portion of the panel. As shown in FIG. 3A, two lines or more dummy cells are formed on the upper portion of the panel. It is preferable that the dummy cells are formed in the outside of the effective region 42 of the panel in which an image is displayed.

The dummy electrode is maintained as a floating state, or, if necessary, a predetermined voltage can be applied.

It is preferable that the structure of the dummy electrode 44 formed in the dummy cell is identical with the electrode structure of the discharge cell 47 existing in the effective region 42. Further, it is preferable that, as shown in FIG. 3A, three cells R, G, B 46 adjacent to the left side of the effective region 42 are formed as a dummy cell.

It is preferable that the edge structure of the right side of the upper portion of the plasma display panel according to the present invention is symmetrical with the structure illustrated in FIG. 3A.

FIG. 3B is a cross-periodal view showing an embodiment of the edge structure of the right side of the lower portion of the plasma display panel.

As shown in FIG. 3B, it is preferable that the width of the row barrier rib 60 and the column barrier rib 61 of the outmost of the panel is broader than the width of the barrier ribs of the inside. Further, as described in the above, it is preferable that the width of the row barrier rib 40 ranges 500 μm or 900 μm. The cells 68, 69, 70 positioned in the outer most among a plurality of discharge cells included in the panel are partitioned with dummy barrier ribs, and as shown in FIG. 3A, only electrode lines for supplying a driving signal to the electrodes are extended on them. Further, it is preferable that the three cells R, G, B of the edge of the right side of the panel are divided by the dummy barrier rib. It is preferable that a protruding electrode as formed in different cells is not formed in the cell divided by the dummy barrier rib.

Further, the dummy cell including dummy electrodes which do not have an effect on the display image is formed on the lower portion of the panel. As shown in FIG. 3B, two line dummy cells are formed on the lower portion of the panel. It is preferable that the dummy cells are formed in the outside of the effective region 67 of the panel in which an image is displayed.

The dummy electrode is maintained as a floating state, or, if necessary, a predetermined voltage can be applied.

It is preferable that the structure of the dummy electrode 64 formed in the dummy cell is identical with the electrode structure of the discharge cell 67 existing in the effective region 62. Further, it is preferable that, as shown in FIG. 3B, three cells R, G, B 66 adjacent to the right side of the effective region 62 are formed as a dummy cell.

As FIG. 3A and FIG. 3B are just an embodiment of the edge structure of the plasma display panel according to the present invention, the structure of the plasma display panel according to the present invention is not restricted in FIG. 3B. For example, the dummy line positioned in the lower portion can be three or more. Three cells R, G, B 46, 66 adjacent to the right side or the left side of the effective region 42, 62 are partitioned by the dummy barrier rib, and thus, the electrode may not be formed in the cells. Further, the electrode structure formed in the dummy cell or in the discharge cell of the effective region 42, 62 can have a various type.

It is preferable that the left side of the lower portion of the edge structure of the plasma display panel according to the present invention is symmetrical with the structure illustrated in FIG. 3B.

It is preferable that the plasma display apparatus according to the present invention includes a filter for preventing the reflection of the external light, shielding an electromagnetic wave, and correcting a color. As an example of the filter, a glass filter or a clear filter can be given to the plasma display panel. Films having the function as described above are adhered on the glass substrates to form the glass filter, while the clear filter is a film-type in which films having various functions are adhered to a film of plastic material, for example, a PolyEthylene Terephthalate PET. In addition, the black matrix is formed in the outside of the effective region of the panel. In this case, the plasma display panel according to the present invention is equipped with the clear filter of film type.

Figure 4:
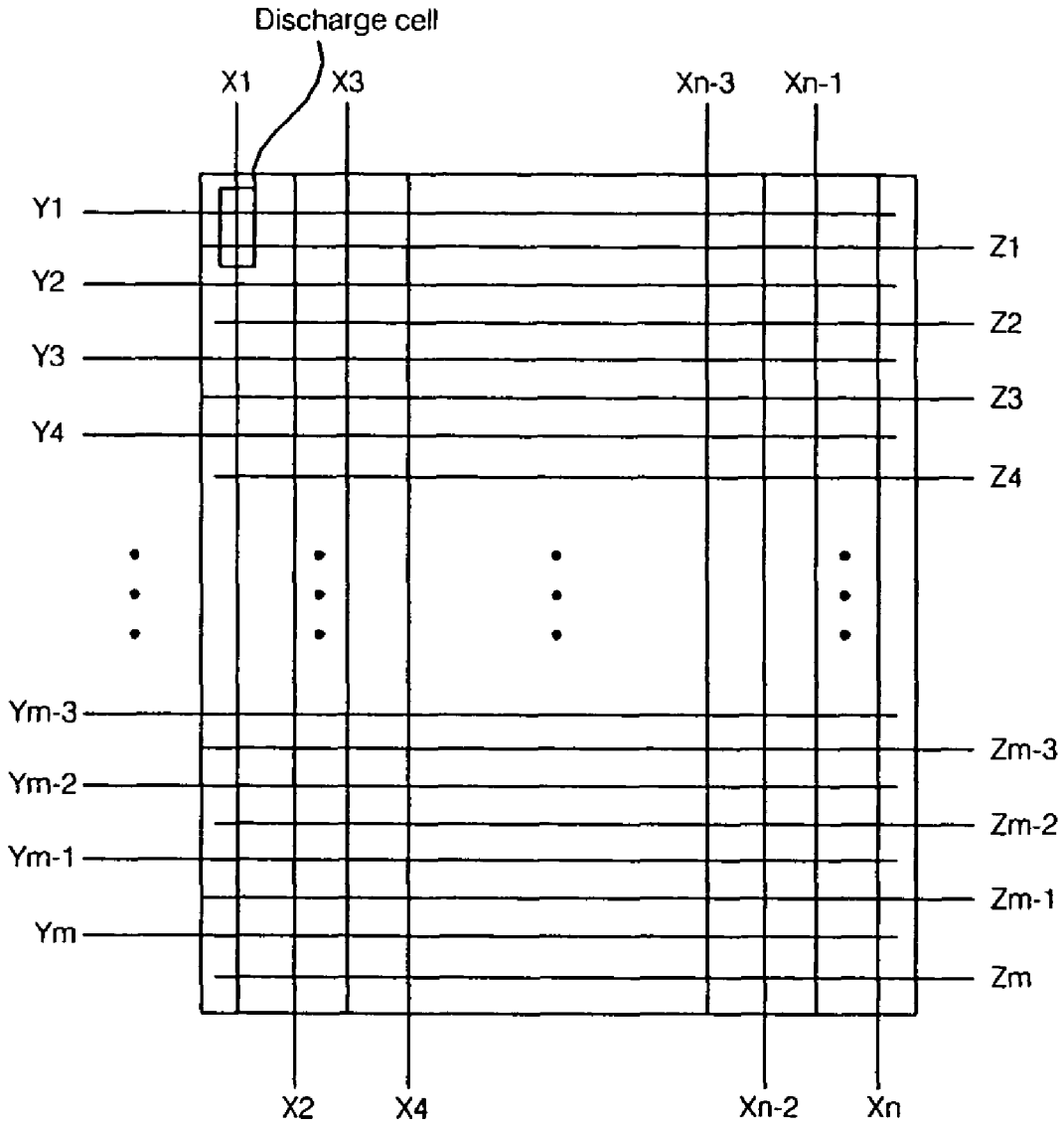
FIG. 4 is a cross-periodal view showing an embodiment of the electrode arrangement of a plasma display panel.

FIG. 4 shows an embodiment of the electrode arrangement of a plasma display panel. As shown in FIG. 4, a plurality of discharge cells comprising the plasma display panel is arranged as a matrix type. A plurality of discharge cells are provided in the interperiod of the address electrode line X1 to Xn with the scan electrode line Y1 to Ym, and the sustain electrode line Z1 to Zm. The scan electrode lines Y1 to Ym are sequentially driven, while the sustain electrode lines Z1 to Zm are commonly driven. The address electrode lines X1 to Xn are divided into even number lines and odd number lines to drive.

The electrode arrangement shown in FIG. 4 is just an embodiment of the electrode arrangement of the plasma panel according to the present invention. Therefore, the present invention is not restricted in the electrode arrangement and the driving method of the plasma display panel shown in FIG. 4. For example, the dual scan mode in which two scan electrode lines among the scan electrode lines Y1 to Ym are driven simultaneously is available. Further, as to the electrode arrangement, the scan electrode line and the sustain electrode line can not alternately be arranged, but the scan electrode line and the sustain electrode line can be sequentially arranged with two lines Y-Z-Z-Y-Y-Z-Z-Y, . . . . Further, in the central part of the panel, the address electrode can be divided in the direction of the scan electrode line or the sustain electrode line.

As described in the above, it is preferable that the electrode structure formed in the dummy cell is identical with the electrode structure formed in the discharge cell of the effective region. FIG. 5 to FIG. 15 are a cross-periodal view showing embodiments of a sustain electrode structure formed in the dummy cell and a sustain electrode structure formed in the discharge cell of the effective region.

Figure 5:
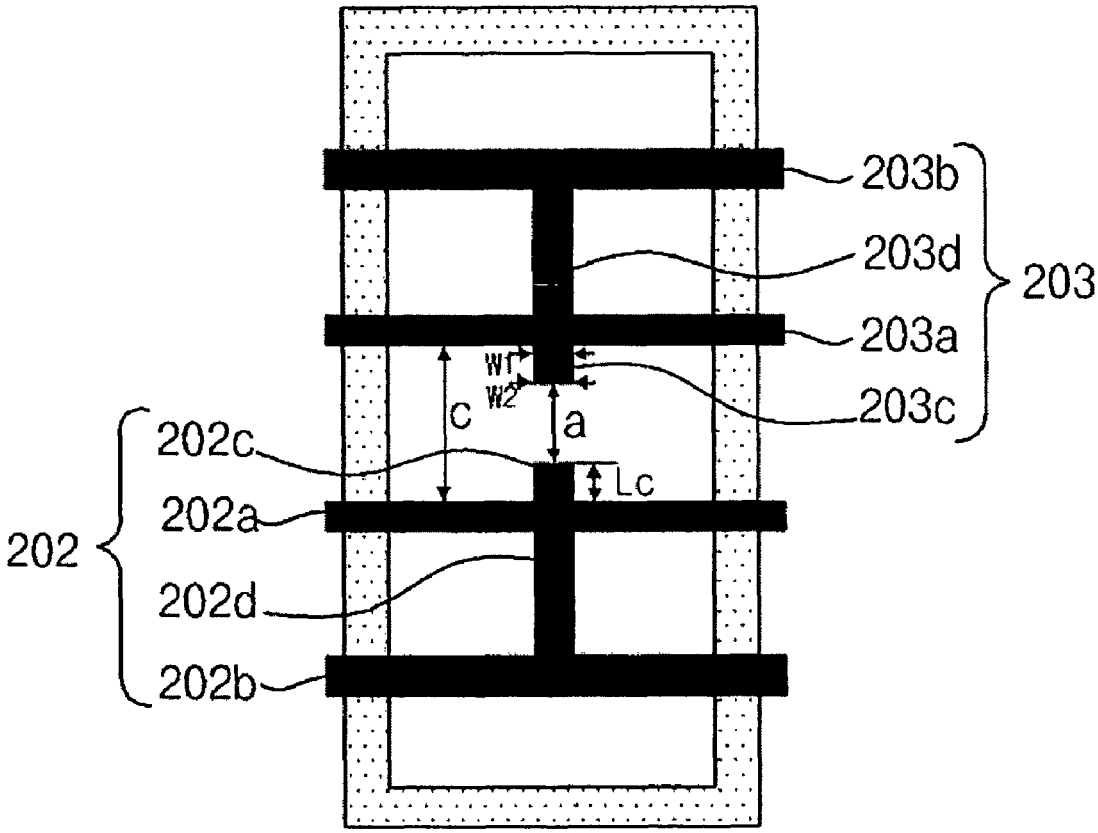
FIG. 5 is a cross-periodal view showing a first embodiment of a sustain electrode structure.

FIG. 5 is a cross-periodal view showing a first embodiment of a sustain electrode structure of the plasma display panel according to the present invention, while the arrangement structure of the sustain electrode pair 202, 203 formed in one discharge cell of the plasma display panel shown in FIG. 2 is briefly showed.

As shown in FIG. 5, the sustain electrode 202, 203 according to the first embodiment of the present invention forms a pair to be symmetrical on the substrate based on the center of the discharge cell. Each sustain electrode comprises a line part including at least two electrode lines 202*a*, 202*b*, 203*a*, 203*b* crossing the discharge cell, and a protrusion part including at least one projecting electrodes 202*c*, 203*c* protruded in the direction of the center of the discharge cell in the discharge cell, while the protrusion part is connected to electrode lines 202*a*, 203*a* which are most close to the center of the discharge cell. Further, it is preferable that, as shown in FIG. 5, each of the sustain electrode 202, 203 further comprises one bridge electrode 202*d*, 203*d* connecting electrode line 202*a* to 202*b*, and 203*a* to 203*b* respectively.

Electrode lines 202*a*, 202*b*, 203*a*, 203*b* cross the discharge cell, extended to a direction of the plasma display panel. The electrode line according to the first embodiment of the present invention is formed with a narrow width in order to improve the aperture ratio. Further, it is preferable that a plurality of electrode lines 202*a*, 202*b*, 203*a*, 203*b* are used in order to improve the discharge diffusion efficiency, while the number of electrode lines are determined in consideration of the aperture ratio.

It is preferable that the width of the electrode line 202*a*, 202*b*, 203*a*, 203*b* ranges from 30 μm to 60 μm, thus, the aperture ratio of the panel necessary for the display can be obtained to maintain the luminance of the display image.

It is preferable that projecting electrodes 202*c*, 203*c* are connected to electrode lines 202*a*, 203*a* which are most close to the center of the discharge cell in one discharge cell, protruded in the direction of the center of the discharge cell. Projecting electrodes 202*c*, 203*c* lower the firing voltage in the plasma display panel driving. Since the firing voltage increases due to the distance c between the electrode lines 202*a*, 203*a*, projecting electrodes 202*c*, 203*c* respectively connected to the electrode line 202*a*, 203*a* are included in the first embodiment of the present invention. Since a discharge can be initiated in the low firing voltage between the projecting electrodes 202*c*, 203*c* closely formed, the firing voltage of the plasma display panel can be lowered. Here, the firing voltage means the voltage level in which a discharge is initiated when a pulse is supplied to at least one electrode between the sustain electrode pair 202, 203.

As to the projecting electrodes 202*c*, 203*c*, as the size is very small, due to the tolerance of the manufacturing process, the width W1 of the part substantially connected to the electrode lines 202*a*, 203*a* of the projecting electrodes 202*c*, 203*c* can be formed broader than the width of W2 of the end part of the projecting electrode, if necessary, the width of W2 of the end part can be made to be more broad.

The gap between the two adjacent electrode lines comprising the sustain electrode pair 203, 202, that is, the gap between 203*a* and 203*b*, or the gap between 202*a* and 202*b* ranges from 80 μm to 120 μm. If the gap between the two adjacent electrode lines has a value as described in the above, the aperture ratio of the plasma display panel is sufficiently obtained and the luminance of the display image can be increased. The discharge diffusion efficiency in the discharge space can be increased.

It is preferable that the width W1 of projecting electrodes 202*c*, 203*c* ranges from 35 μm to 45 μm. If the width of projecting electrodes 202*c*, 203*c* has a value as described in the above, the reduction of image luminance due to the blocking of light which is reflected to the front of the display device owing to the small aperture ratio of the plasma display panel by the projecting electrodes 202*c*, 203*c* can be prevented.

Further, it is preferable that the gap a between the projecting electrodes 202*c*, 203*c* ranges from 15 μm to 165 μm. If the gap a of the projecting electrodes 202*c*, 203*c* has a value as described in the above, the shortening of electrode lifetime due to an excessive discharge generated between the projecting electrodes 202*c*, 203*c* can be prevented. Thus, a proper firing voltage for driving the plasma display panel can be obtained.

Bridge electrodes 202*d*, 203*d* connect the electrode line 202*a* to 202*b*, and connect 203*a* to 203*b* when the electrodes 202*a*, 202*b*, and 203*a*, 203*b* comprises sustain electrodes 202, 203. Bridge electrodes 202*d*, 203*d* make the discharge initiated through the projecting electrodes 202*c*, 203*c* to be diffused easily to the electrode lines 202*b*, 203*b* which are far from the center of the discharge cell.

As described, by suggesting the number of electrode lines, the electrode structure according to the first embodiment of the present invention can improve the aperture ratio. Further, by forming the projecting electrodes 202*c*, 203*c*, the firing voltage can be lowered. Further, the discharge diffusion efficiency is increased with the electrode lines 202*b*, 203*b* which are far from the center of the discharge cell and the bridge electrodes 202*d*, 203*d*, so that the luminous efficiency of the plasma display panel can be improved. That is, the brightness which is identical with the brightness of the conventional plasma display panel, or the more brightness can be obtained. Therefore, the ITO transparent electrode can not be used.

Figure 6:
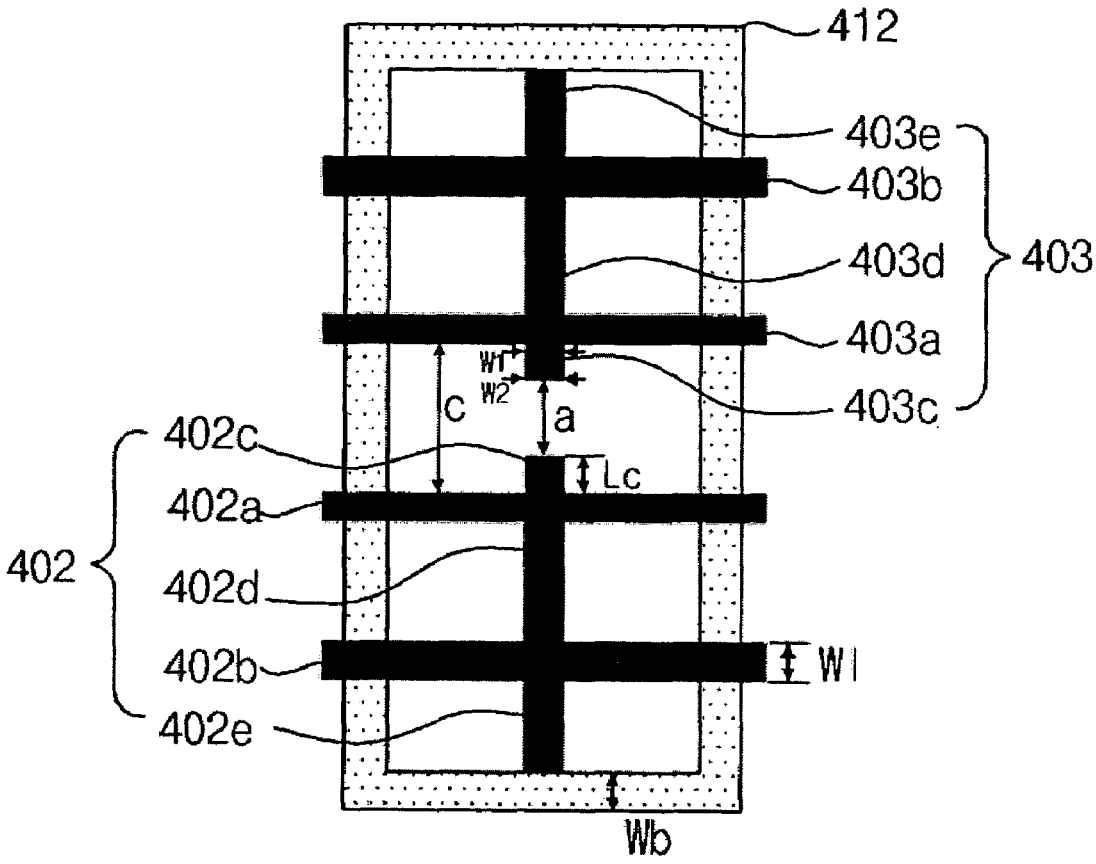
FIG. 6 is a cross-periodal view showing a second embodiment of a sustain electrode structure.

FIG. 6 is a cross-periodal view showing a second embodiment of a sustain electrode structure of a plasma display panel, while the arrangement structure of the sustain electrode pair 402, 403 formed in one discharge cell of the plasma display panel shown in FIG. 2 is briefly showed.

As shown in FIG. 6, each sustain electrode 402, 403 comprises at least two electrode lines 402*a*, 402*b*, 403*a*, 403*b* crossing the discharge cell, a first projecting electrode 402*c*, 403*c* protruded in the direction of the center of the discharge cell in the discharge cell, while the first projecting electrodes are connected to electrode lines 402*a*, 403*a* which are most close to the center of the discharge cell, a bridge electrode 402*d*, 403*d* connecting the two electrode lines 402*a* to 402*b*, and 403*a* to 403*b*, and a second projecting electrode 402*e*, 403*e* protruded in the opposite direction of the center of the discharge cell in the discharge cell, while the second projecting electrodes are connected to electrode lines 402*b*, 403*b* which are most far from the center of the discharge cell.

The width of the electrode lines 402*a*, 402*b*, 403*a*, 403*b* ranges from 30 μm to 60 μm. Accordingly, the aperture ratio of the panel necessary for the display can be obtained to maintain the luminance of the dispaly image.

Electrode lines 402*a*, 402*b*, 403*a*, 403*b* cross the discharge cell, extended to a direction of the plasma display panel. The electrode line according to the second embodiment of the present invention is formed with a narrow width in order to improve the aperture ratio. Preferably, the width W1 of the electrode line ranges from 20 μm to 70 μm, to improve the aperture ratio, and to easily generate a discharge.

As shown in FIG. 6, electrode lines 402*a*, 403*a* which are close to the center of the discharge cell are connected to the first projecting electrodes 402*c*, 403*c*. The electrode lines 402*a*, 403*a* which are close to the center of the discharge cell form a path where a discharge diffusion is initiated with the beginning of the discharge. The electrode lines 402*b*, 403*b* which are far from the center of the discharge cell performs a discharge diffusion to the peripheral unit of the discharge cell.

The first projecting electrodes 402*c*, 403*c* are connected to the electrode lines 402*a*, 403*a* close to the center of the discharge cell in one discharge cell, protruded in the direction of the center of the discharge cell. Preferably, the first projecting electrodes are formed in the center of electrode lines 402*a*, 403*a*. As the first projecting electrodes 402*c*, 403*c*, by corresponding each other, are formed in the center of the electrode line, the firing voltage of the plasma display panel can be effectively lowered.

It is preferable that the width W1 of the projecting electrodes 402*c*, 403*c* ranges from 35 μm to 45 μm, while the gap a between the projecting electrodes 402*c*, 403*c* ranges from 15 μm to 165 μm. As the width of the projecting electrodes 402*c*, 403*c* and the critical meaning of the upper value and the lower value are identical with the description illustrated with reference to FIG. 5, it will be omitted.

Bridge electrodes 402*d*, 403*d* connect the electrode line 402*a* to 402*b*, and connect 403*a* to 403*b* when the electrodes 402*a*, 402*b*, and 403*a*, 403*b* comprises sustain electrodes 402, 403. Bridge electrodes 402*d*, 403*d* make the discharge initiated through the projecting electrodes to be diffused easily to the electrode lines 402*b*, 403*b* which are far from the center of the discharge cell. Here, bridge electrodes 402*d*, 403*d* are positioned in the discharge cell, however, if necessary, they can be formed in the barrier rib 412 partitioning the discharge cell.

Accordingly, in the second embodiment of the sustain electrode structure of the plasma display panel according to the present invention, a discharge can be diffused over the space between the electrode lines 402*b*, 403*b* and the barrier rib 412. Accordingly, the discharge diffusion efficiency is increased. In that way, the luminous efficiency of the plasma display panel can be improved. Further, a second projecting electrode 402*e*, 403*e* is connected to the electrode lines 402*b*, 403*b* which are far from the center of the discharge cell and protruded to the opposite direction of the center of the discharge cell.

The length of the second projecting electrodes 402*e*, 403*e*, ranges from 50 μm to 100 μm. By obtaing the value as described in the above, a discharge can be effectively diffused to the discharge space which is far from the discharge cell center.

As shown in FIG. 6, the second projecting electrodes 402*e*, 403*e* can be extended to the barrier rib 412 partitioning the discharge cell. Further, if the aperture ratio can be sufficiently compensated from the other part, it is possible to partly extend on the barrier rib 412 in order to more improve the discharge diffusion efficiency. However, it is preferable that if the second projecting electrodes 402*e*, 403*e* are not extended to the barrier rib 412, the gap between the second projecting electrodes 402*e*, 403*e* and the barrier rib 412 adjacent to the second projecting electrodes is 70 μm or less. When the gap between the second projecting electrodes 402*e*, 403*e* and the barrier rib 412 is 70 μm or less, a discharge can be diffused effectively to the discharge space which is far from the center of the discharge cell.

It is preferable that, in the second embodiment of the sustain electrode structure of the present invention, the second projecting electrodes 402*e*, 403*e* are formed in the center of the electrode lines 402*b*, 403*b* to widely diffuse a discharge over the peripheral unit of the discharge cell.

In the meantime, it is preferable that, in the second embodiment of the present invention, the width Wb of the barrier rib positioned in the direction where the second projecting electrodes 402*e*, 403*e* is extended among barrier ribs partitioning the discharge cell is 200 μm or less. Further, a black matrix (not shown) for securing a bright room contrast by absorbing the external light and preventing the discharge light from being diffused throughout the neighboring discharge cell and being displayed is formed on the barrier rib 412. The width of the barrier rib 412 is suggested to be 200 μm or less. In that way, the region of the discharge cell is increased. Accordingly, the luminous efficiency can be increased, thus, the reduction of aperture ratio due to the second projecting electrode can be compensated. Preferably, the width Wb of the barrier rib positioned in the direction where the second projecting electrode is extended ranges from 90 μm to 100 μm so that the optimum luminous efficiency can be obtained.

Figure 7:
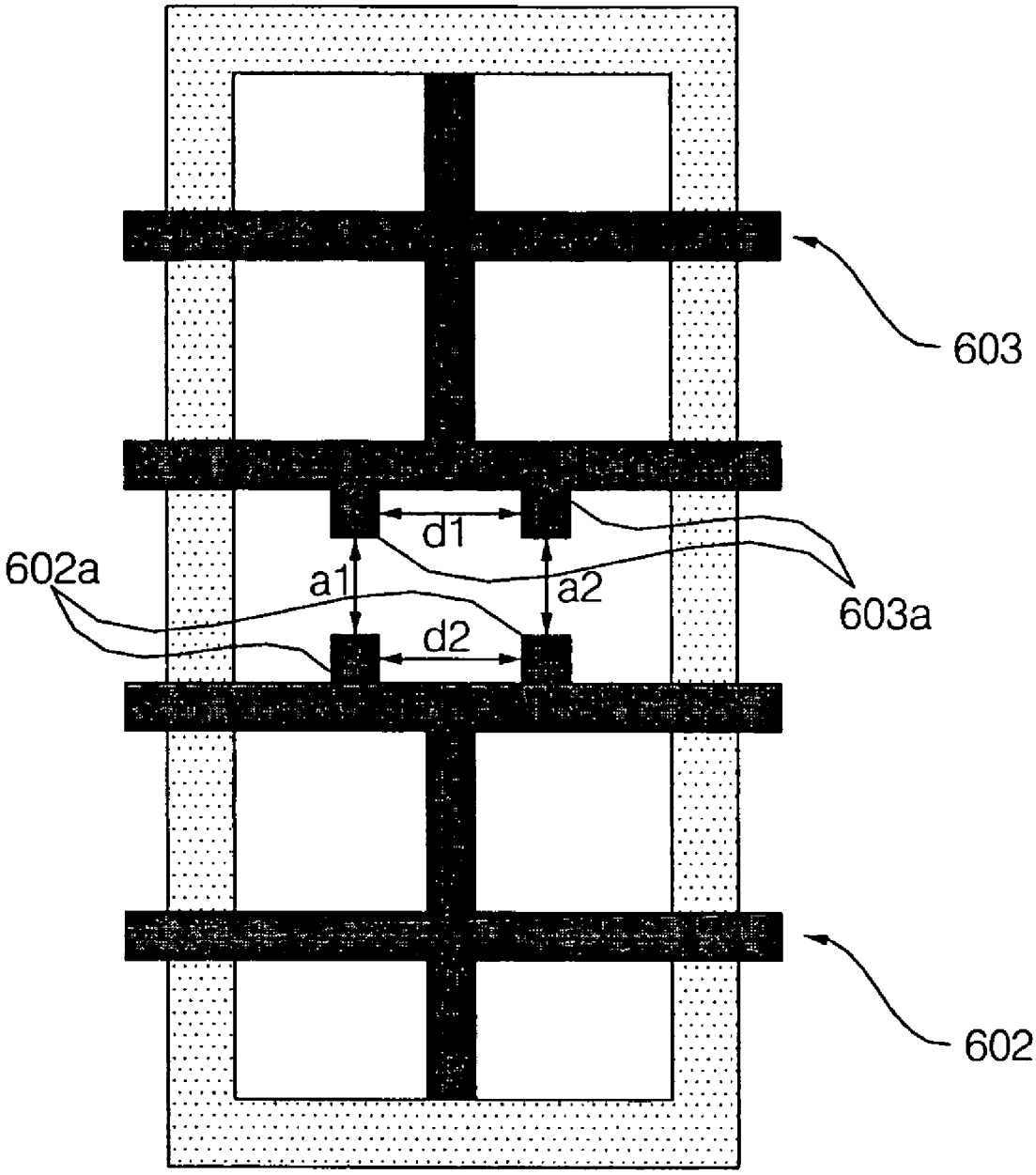
FIG. 7 is a cross-periodal view showing a third embodiment of a sustain electrode structure.

FIG. 7 is a cross-periodal view showing a third embodiment of a sustain electrode structure. The same description described in FIG. 6 on the sustain electrode structure among the content shown in FIG. 7 will be omitted.

As shown in FIG. 7, in the third embodiment of the sustain electrode structure according to the present invention, a first projecting electrode 602*a*, 603*a* comprising two electrodes is formed in each of the electrode 602, 603. The first projecting electrodes 602*a*, 603*a* are connected to the electrode line close to the center of the discharge cell, protruded in the direction of the center of the discharge cell. Preferably, each of the first projecting electrodes 602*a*, 603 is formed to be symmetrical based on the center of the electrode line.

It is preferable that the width of the first projecting electrode 602*a*, 603*a* ranges from 35 μm to 45 μm. As the description on the critical meaning of the upper and the lower value of the width of the projecting electrodes is identical with the description illustrated with reference to FIG. 5, it will be omitted.

The gap d1, d2 between the first projecting electrode comprising two electrodes protruded from one electrode line ranges from 50 μm to 100 μm when the plasma display panel has the size of 42 inch and the resolution of VGA. The gap ranges from 30 μm to 80 μm when the plasma display panel has the size of 42 inch and the resolution of XGA. The gap ranges from 40 μm or 90 μm when the plasma display panel has the size of 50 inch and the resolution of XGA.

When the gap d1, d2 of the first projecting electrode has the range as described in the above, the aperture ratio for implementing the luminance of an image required for the display device can be obtained. Thus, the incrase of power consumed in the display over a limit due to the increase of the reactive power owing to the close of the first projecting electrode to a barrier rib can be prevented.

As the two first projecting electrodes 602*a*, 603*a* are formed on each of the sustain electrode 602, 603, the electrode region in the center of the discharge cell increases. Accordingly, before a discharge is initiated, the space charge is very much formed in the discharge cell so that the firing voltage is more decreased, and the discharge rate is increased. Additionally, after the discharge is initiated, the wall charge amount increases, a luminance rises, and a discharge is uniformly diffused throughout the whole discharge cell.

It is preferable that the width of electrode lines 602, 603 ranges from 30 μm to 60 μm, accordingly, the aperture ratio of panel necessary for the display can be obtained to maintain the luminance of the display image.

Further, it is preferable that the gap a1, a2 between the first projecting electrodes 602*c*, 603*c*, that is, the gap a1, a2 between the two projecting electrodes in the direction intersecting with the electrode lines 602, 603 ranges from 15 μm to 165 μm. As the description on the critical meaning of the upper value and the lower value of the gap of the projecting electrodes is identical with the description illustrated with reference to FIG. 5, it will be omitted.

Figure 8:
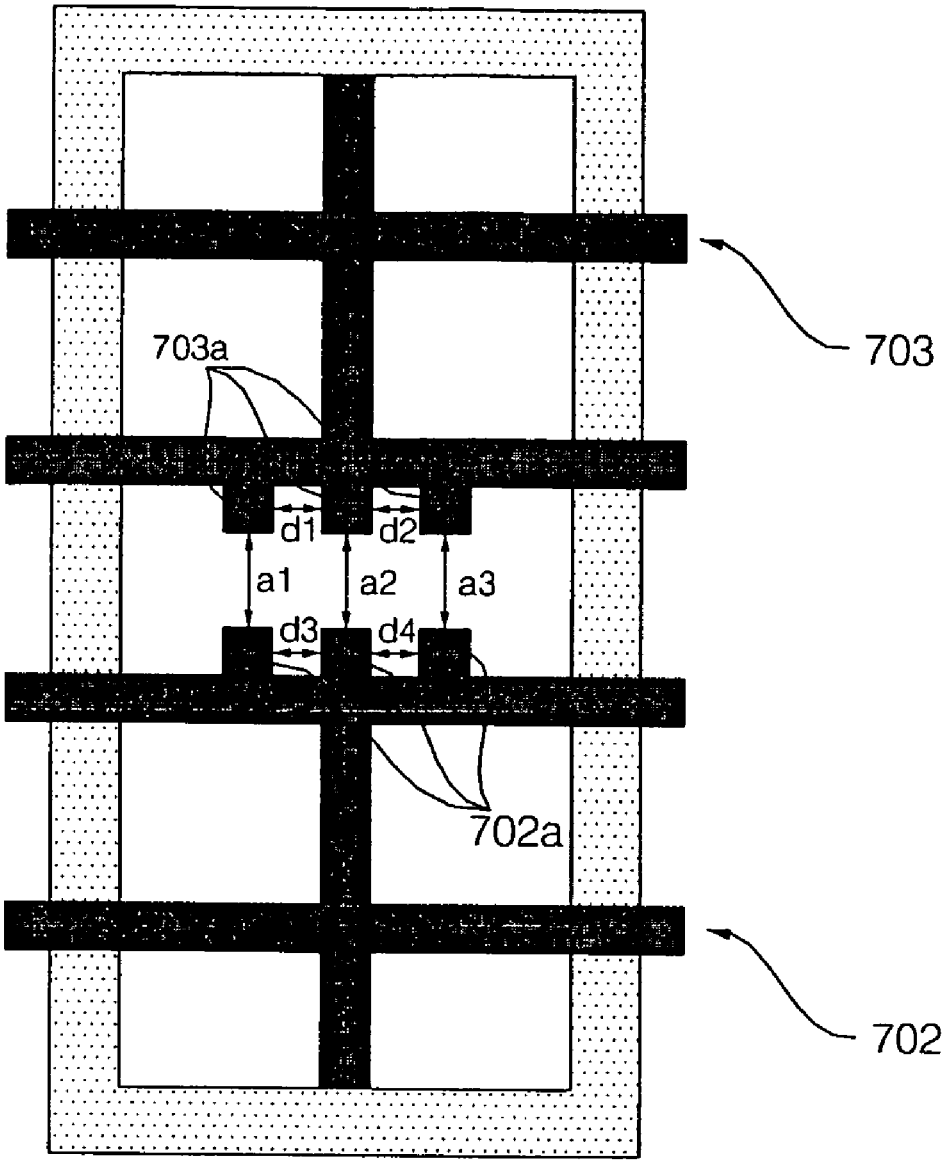
FIG. 8 is a cross-periodal view showing a fourth embodiment of a sustain electrode structure.

FIG. 8 is a cross-periodal view showing a fourth embodiment of a sustain electrode structure. The same description described in FIG. 6 and FIG. 7 on the sustain electrode structure among the contents shown in FIG. 8 will be omitted.

As shown in FIG. 8, in the fourth embodiment of the sustain electrode structure according to the present invention, a first projecting electrode 702*a*, 703*a* comprising three electrodes is formed in each of the electrode 702, 703.

The first projecting electrodes 702*a*, 703*a* are connected to the electrode line close to the center of the discharge cell, protruded in the direction of the center of the discharge cell. It is preferable that one of the first projecting electrodes is formed in the center of the electrode line, other two the first projecting electrodes are formed to be symmetrical based on the center of the electrode line. As the three first projecting electrodes 702*a*, 703*a* are formed on each of the sustain electrode 702, 703, the firing voltage is more decreased, and the discharge rate is more increased. Additionally, after the discharge is initiated, the luminance is more increased and a discharge is uniformly diffused throughout the whole discharge cell.

By increasing the number of the first projecting electrode, the electrode region in the center of the discharge cell increases. Accordingly, the firing voltage is decreased and the luminance is increased. On the other hand, it shoud be noted that the most strong discharge is performed and the brightest light is emitted in the center of the discharge cell. That is, as the number of the first projecting electrode is increased, the light emitted is remarkably decreased by blocking the light emitted in the center of the discharge cell. In addition, preferably, both the firing voltage and the luminous efficiency shoud be considered to select the optimum number of the sustain electrode for designing the structure of the sustain electrode.

It is preferable that the width of the first electrode 702*a*, 703*a* ranges from 35 μm to 45 μm, while the gap a1, a2, a3 between the first projecting electrodes 702*c*, 703*c* ranges from 15 μm to 165 μm. As the description on the critical meaning of the upper and the lower value of the width and the gap of the first projecting electrode 702*a*, 703*a* is identical with the description illustrated with reference to FIG. 5, it will be omitted.

Figure 9:
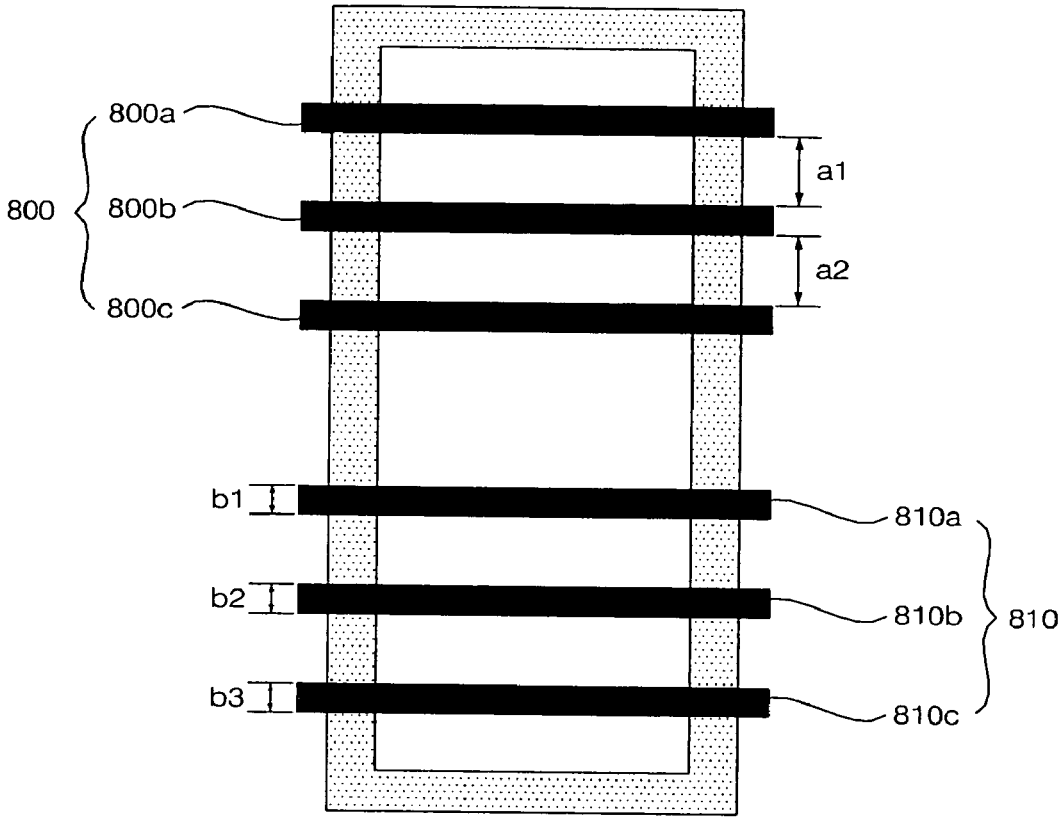
FIG. 9 is a cross-periodal view showing a fifth embodiment of a sustain electrode structure.

FIG. 9 is a cross-periodal view showing a fifth embodiment of a sustain electrode structure of a plasma display panel according to the present invention. The sustain electrode 800, 810 includes three electrode lines 800*a*, 800*b*, 800*c*, 810*a*, 810*b*, 810*c* crossing the discharge cell. The electrode lines are extended in a direction of the plasma display panel, while crossing the discharge cell. As to the electrode lines, the width is narrowly formed to improve an aperture ratio. It is preferable that the width ranges from 20 μm to 70 μm to improve the aperture ratio and have a smooth discharge.

It is preferable that the width of electrode lines 800*a*, 800*b*, 800*c*, 810*a*, 810*b*, 810*c* of the sustain electrode pair ranges from 30 μm to 60 μm. Thus, the aperture ratio of the panel necessary for the display can be obtained and the luminance of the display image can be maintained.

It is preferable that the thicknessh of electrode lines 800*a*, 800*b*, 800*c*, 810*a*, 810*b*, 810*c* of the sustain electrode pair ranges from 3 μm to 7 μm. The gap a1, a2 of three electrode lines comprising each sustain electrode can be identical or different. The width b1, b2, b3 of the electrode lines also can be identical or different. As the description on the critical meaning of the upper and the lower value of the thickness of the electrode line is identical with the description illustrated with reference to FIG. 2, it will be omitted.

Figure 10:
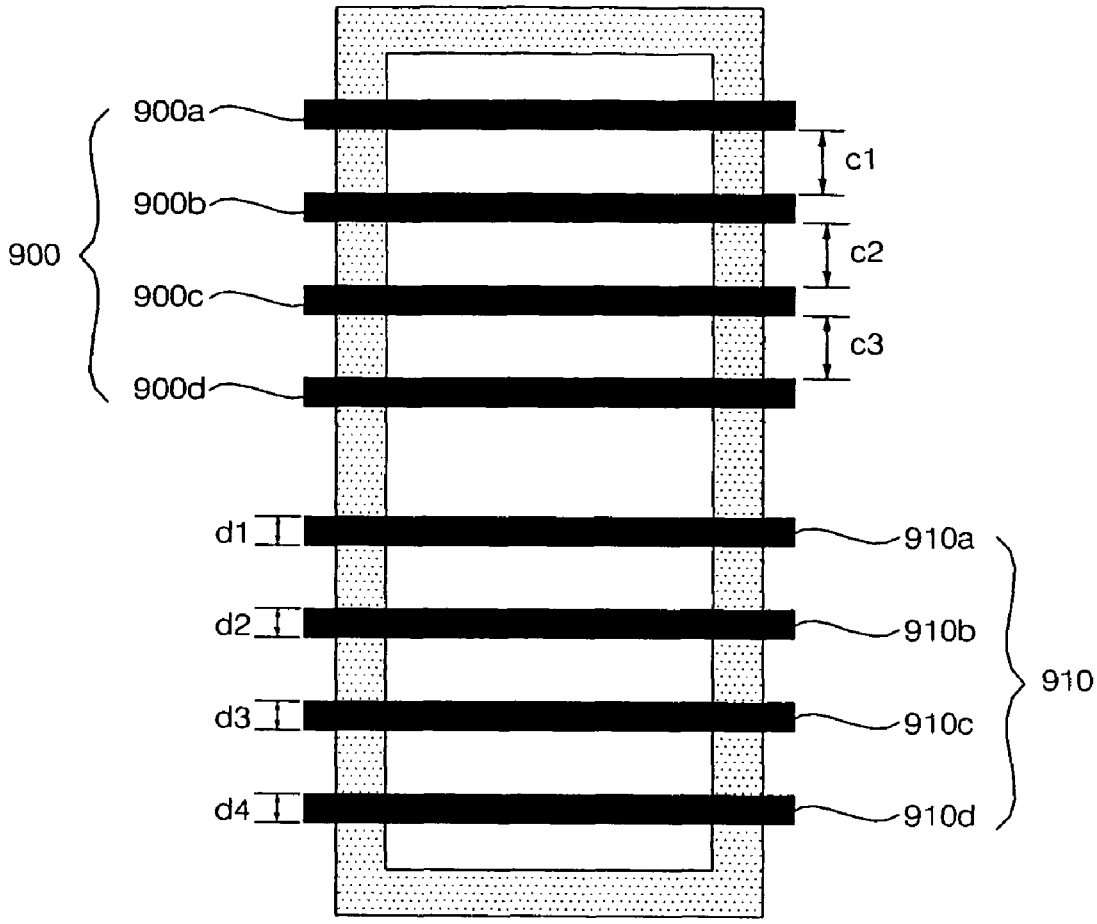
FIG. 10 is a cross-periodal view showing a sixth embodiment of a sustain electrode structure.

FIG. 10 is a cross-periodal view showing a sixth embodiment of a sustain electrode structure of a plasma display panel according to the present invention. The sustain electrode 900, 910 includes four electrode lines 900*a*, 900*b*, 900*c*, 900*d*, 910*a*, 910*b*, 910*c*, 910*d* crossing the discharge cell. The electrode lines are extended in a direction of the plasma display panel, while crossing the discharge cell. As to the electrode lines, the width is narrowly formed to improve an aperture ratio. It is preferable that the width ranges from 20 μm to 70 μm to improve the aperture ratio and have a smooth discharge.

It is preferable that the width of electrode lines 900*a*, 900*b*, 900*c*, 900*d*, 910*a*, 910*b*, 910*c*, 910*d* of the sustain electrode pair ranges from 30 μm to 60 μm. Thus, the aperture ratio of the panel necessary for the display can be obtained and the luminance of the display image can be maintained.

It is preferable that the thicknessh of electrode lines 900*a*, 900*b*, 900*c*, 900*d*, 910*a*, 910*b*, 910*c*, 910*d* of the sustain electrode pair ranges from 3 μm to 7 μm. As the description on the critical meaning of the upper and the lower value of the thickness of the electrode line is identical with the description illustrated with reference to FIG. 2, it will be omitted.

The gap c1, c2, c3 of four electrode lines comprising each sustain electrode can be identical or different. The width d1, d2, d3, d4 of the electrode lines also can be identical or different.

Figure 11:
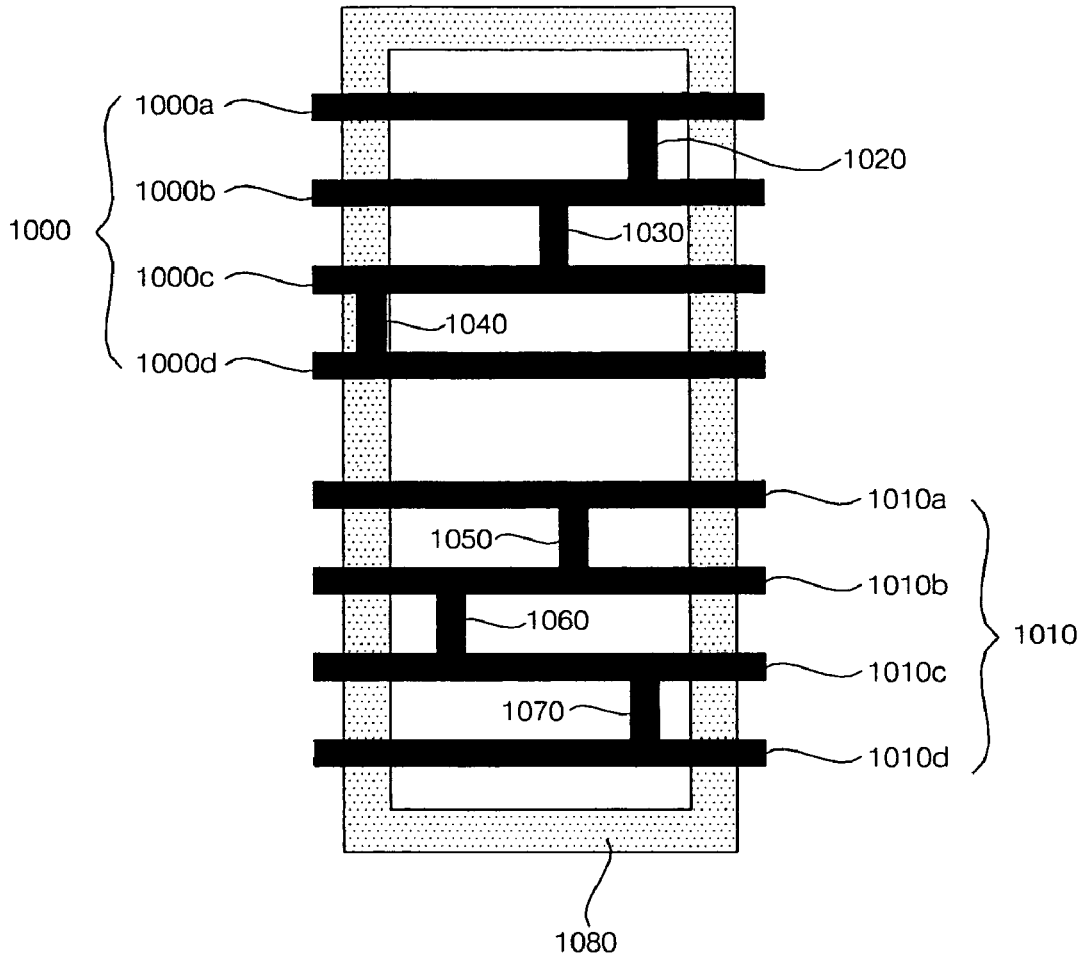
FIG. 11 is a cross-periodal view showing a seventh embodiment of a sustain electrode structure.

FIG. 11 is a cross-periodal view showing a seventh embodiment of a sustain electrode structure of a plasma display panel according to the present invention. Each sustain electrode 1000, 1010 includes four electrode lines 1000*a*, 1000*b*, 1000*c*, 1000*d*, 1010*a*, 1010*b*, 1010*c*, 1010*d* crossing the discharge cell. The electrode lines are extended in a direction of the plasma display panel, while crossing the discharge cell.

It is preferable that the width of electrode lines 1000*a*, 1000*b*, 1000*c*, 1000*d*, 1010*a*, 1010*b*, 1010*c*, 1010*d* of the sustain electrode pair ranges from 30 μm to 60 μm. Thus, the aperture ratio of the panel necessary for the display can be obtained and the luminance of the display image can be maintained.

It is preferable that the thickness of electrode lines 1000*a*, 1000*b*, 1000*c*, 1000*d*, 1010*a*, 1010*b*, 1010*c*, 1010*d* of the sustain electrode pair ranges from 3 μm to 7 μm. As the description on the critical meaning of the upper and the lower value of the thickness of the electrode line is identical with the description illustrated with reference to FIG. 2, it will be omitted.

Bridge electrodes 1020, 1030, 1040, 1050, 1060, 1070 connect 2 electrode lines. As to bridge electrodes 1020, 1030, 1040, 1050, 1060, 1070, the disclosed discharge be easily diffused to the electrode line which the center of the discharge cell is far. As shown in FIG. 11, the location of bridge electrodes 1020, 1030, 1040, 1050, 1060, 1070 does not coincide with. And one bridge electrode 1040 can be located on surface the barrier rib 1080. Each bridge electrodes 1020, 1030, 1040, 1050, 1060, 1070 connect two electrode lines. The bridge electrodes 1020, 1030, 1040, 1050, 1060, 1070 make the initiated discharge to be diffused easily to the electrode lines which are far from the center of the discharge cell. As shown in FIG. 11, the location of bridge electrodes 1020, 1030, 1040, 1050, 1060, 1070 may not coincide. Further, a bridge electrode 1040 can be located on the barrier rib 1080.

Figure 12:
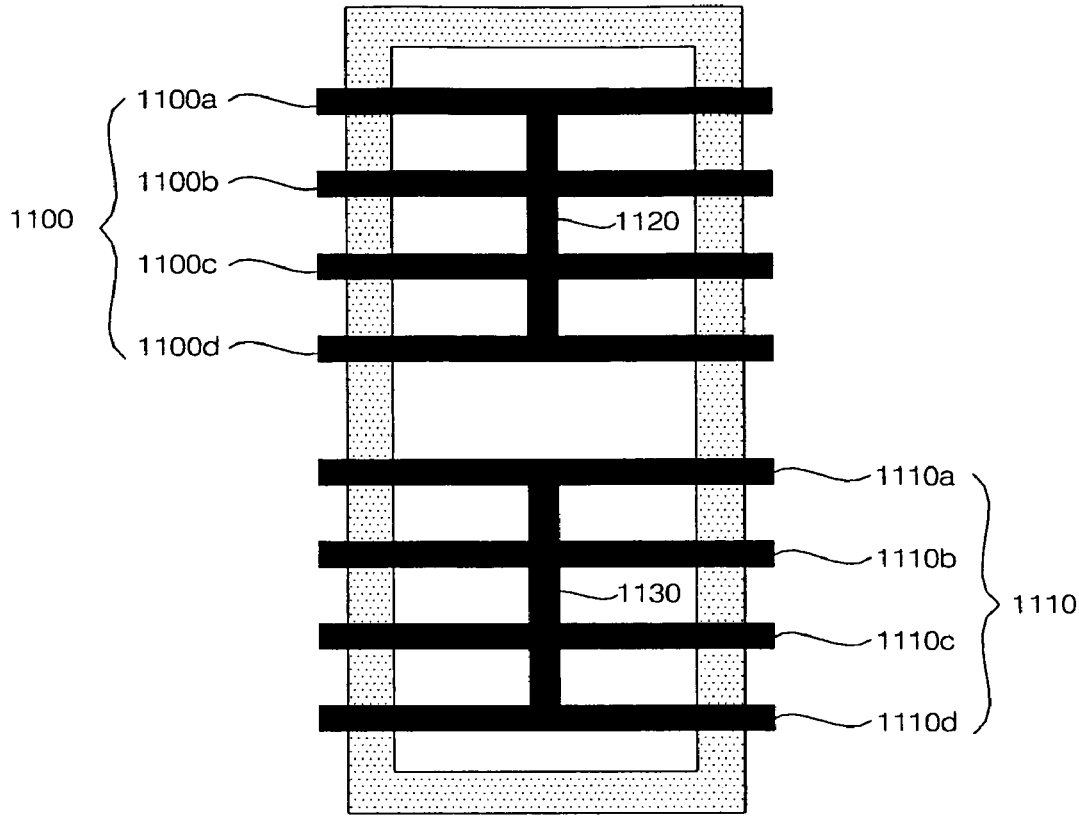
FIG. 12 is a cross-periodal view showing an eighth embodiment of a sustain electrode structure.

FIG. 12 is a cross-periodal view showing an eighth embodiment of a sustain electrode structure of a plasma display panel according to the present invention. Differently with FIG. 11, the bridge electrodes connecting electrode lines are formed on the same position, forming one bridge electrode 1120, 1130 connecting four electrode lines 1100*a*, 1100*b*, 1100*c*, 1100*d*, 1110*a*, 1110*b*, 1110*c*, 1110*d* for each sustain electrode 1100, 1110.

It is preferable that the width of electrode lines 1100*a*, 1100*b*, 1100*c*, 1100*d*, 1110*a*, 1110*b*, 1110*c*, 1110*d* of the sustain electrode pair ranges from 30 μm to 60 μm. Thus, the aperture ratio of the panel necessary for the display can be obtained and the luminance of the display image can be maintained.

It is preferable that the thickness of electrode lines 1100*a*, 1100*b*, 1100*c*, 1100*d*, 1110*a*, 1110*b*, 1110*c*, 1110*d* of the sustain electrode pair ranges from 3 μm to 7 μm. As the description on the critical meaning of the upper and the lower value of the thickness of the electrode line is identical with the description illustrated with reference to FIG. 2, it will be omitted.

Figure 13:
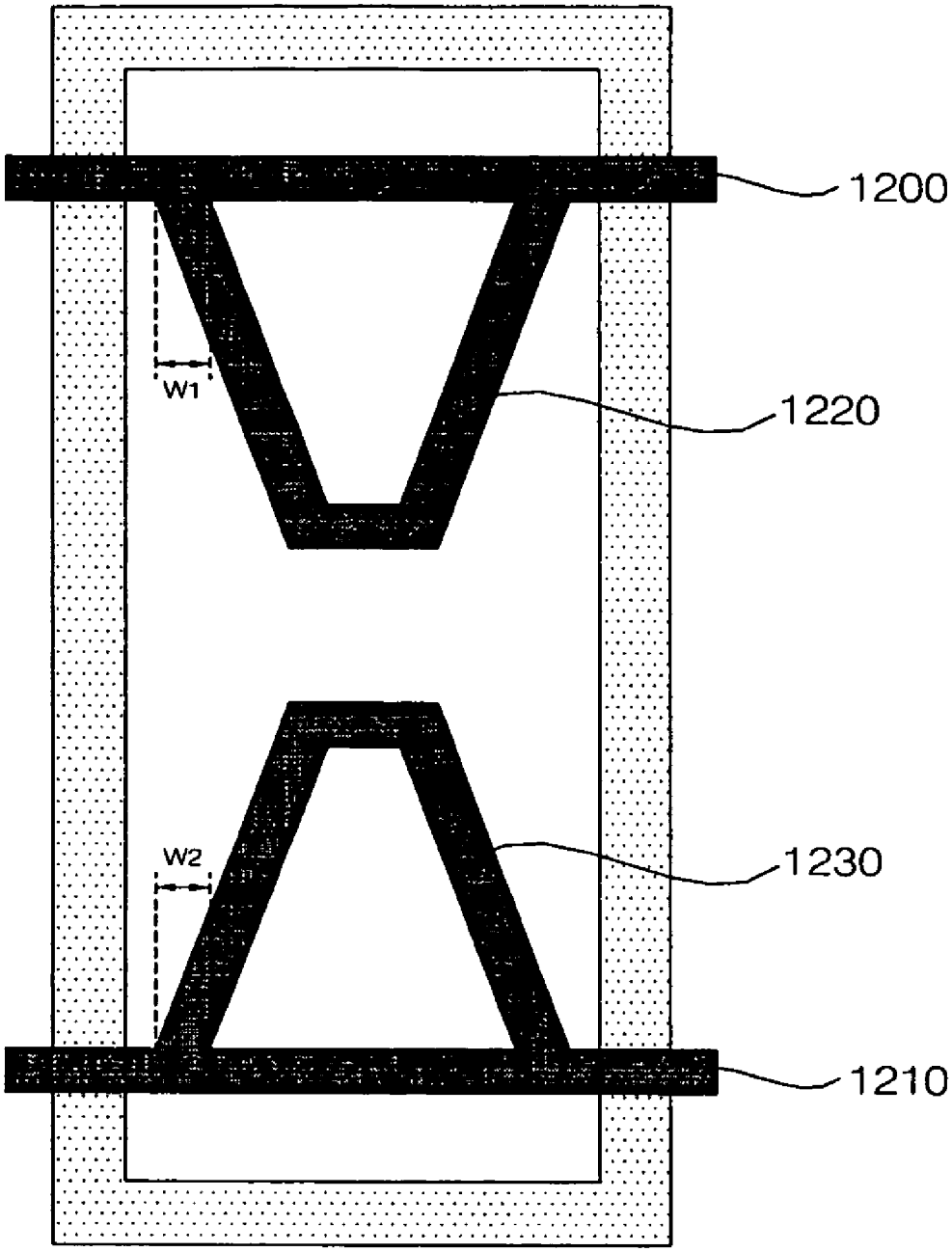
FIG. 13 is a cross-periodal view showing a ninth embodiment of a sustain electrode structure.

FIG. 13 is a cross-periodal view showing a ninth embodiment of a sustain electrode structure of a plasma display panel according to the present invention, forming projecting electrodes 1220, 1230 including a closed loop for each electrode line 1200, 1210. The firing voltage can be lowered and the aperture ratio can be improved by projecting electrodes 1220, 1230 including the closed loop as shown in FIG. 13. The form of the projecting electrode and the closed loop can be varied.

It is preferable that the width of electrode lines 1200, 1210 of the sustain electrode pair ranges from 30 μm to 60 μm. Thus, the aperture ratio of the panel necessary for the display can be obtained and the luminance of the display image can be maintained.

It is preferable that the thickness of electrode lines 1200, 1210 of the sustain electrode pair ranges from 3 μm to 7 μm. As the description on the critical meaning of the upper and the lower value of the thickness of the electrode line is identical with the description illustrated with reference to FIG. 2, it will be omitted.

It is preferable that the width W1, W2 of projecting electrodes 1220, 1230 ranges from 35 μm to 45 μm. If the width W1, W2 of projecting electrodes 1220, 1230 has a value as described in the above, the reduction of image luminance due to the blocking of light which is reflected to the front of the display device owing to the small aperture ratio of the plasma display panel by the projecting electrodes can be prevented.

Further, it is preferable that the gap between the projecting electrodes 1220, 1230 ranges from 15 μm to 165 μm. As the description on the critical meaning of the upper and the lower value of the gap of the projecting electrodes is identical with the description illustrated with reference to FIG. 5, it will be omitted.

Figure 14:
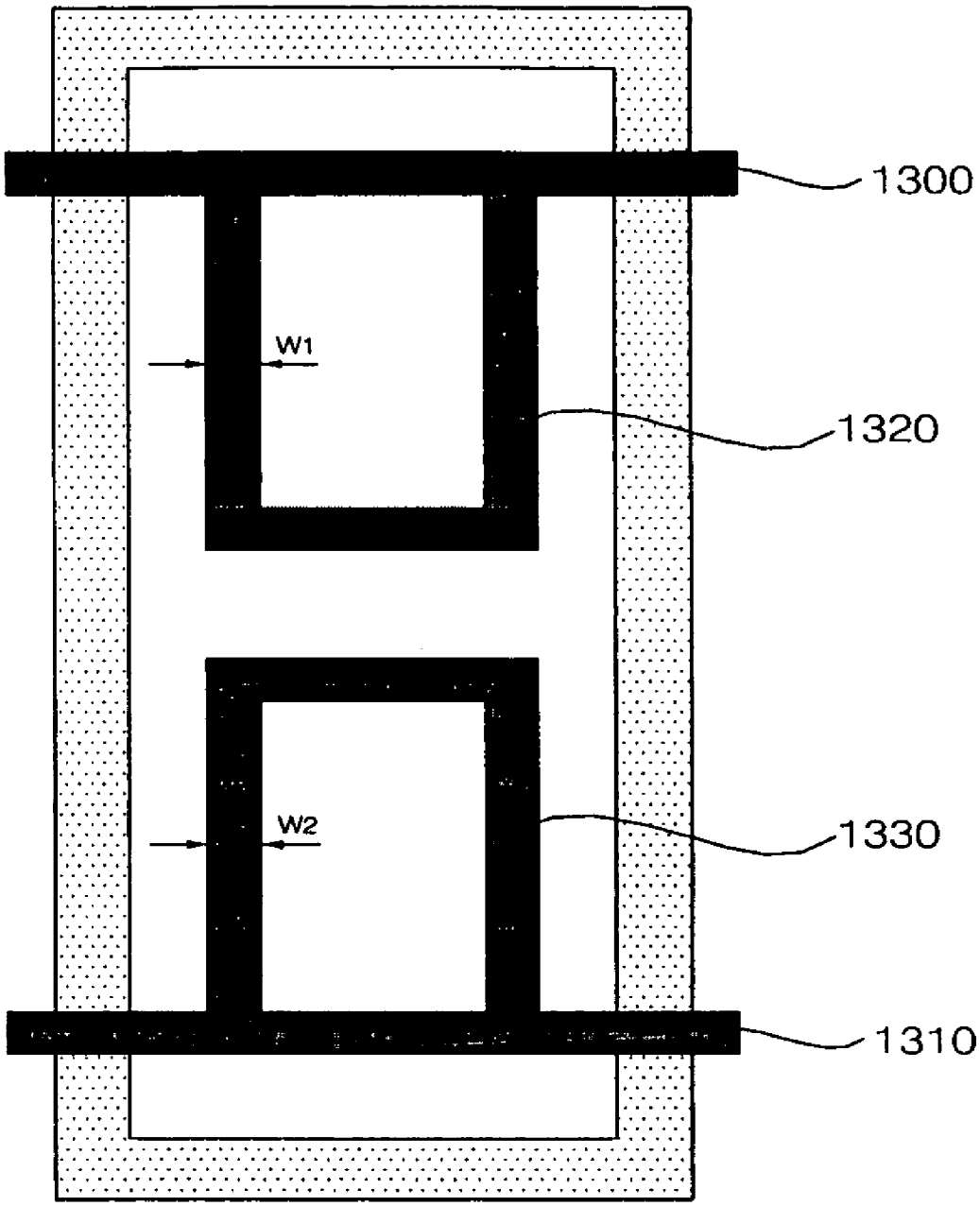
FIG. 14 is a cross-periodal view showing a tenth embodiment of a sustain electrode structure.

FIG. 14 is a cross-periodal view showing a tenth embodiment of a sustain electrode structure of a plasma display panel according to the present invention, forming projecting electrodes 1320, 1330 including a closed loop having a rectangular form for each electrode line 1300, 1310.

It is preferable that the width of electrode lines 1300, 1310 of the sustain electrode pair ranges from 30 μm to 60 μm. Thus, the aperture ratio of the panel necessary for the display can be obtained and the luminance of the display image can be maintained.

It is preferable that the thickness of electrode lines 1300, 1310 of the sustain electrode pair ranges from 3 μm to 7 μm. As the description on the critical meaning of the upper and the lower value of the thickness of the electrode line is identical with the description illustrated with reference to FIG. 2, it will be omitted.

It is preferable that the width W1, W2 of projecting electrodes 1320, 1330 ranges from 35 μm to 45 μm. As the description on the critical meaning of the upper and the lower value of the width W1, W2 of the projecting electrode 1320, 1330 is identical with the description illustrated with reference to FIG. 12, it will be omitted.

Further, it is preferable that the gap between the projecting electrodes 1320, 1330 ranges from 15 μm to 165 μm. As the description on the critical meaning of the upper and the lower value of the gap of the projecting electrode is identical with the description illustrated with reference to FIG. 5, it will be omitted.

Figure 15A:
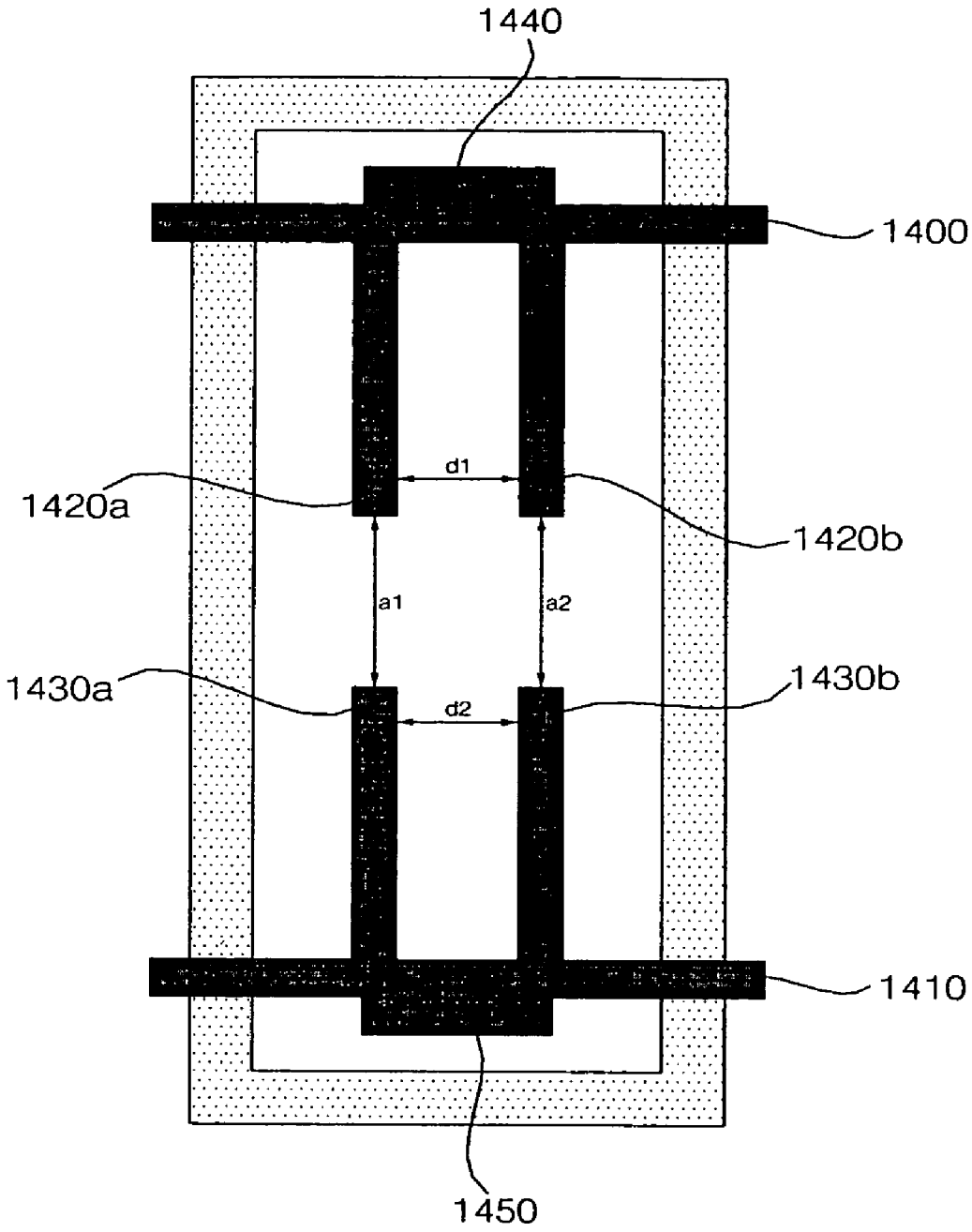
FIG. 15A and FIG. 15B are a cross-periodal view showing an eleventh embodiment of a sustain electrode structure.
Figure 15B:
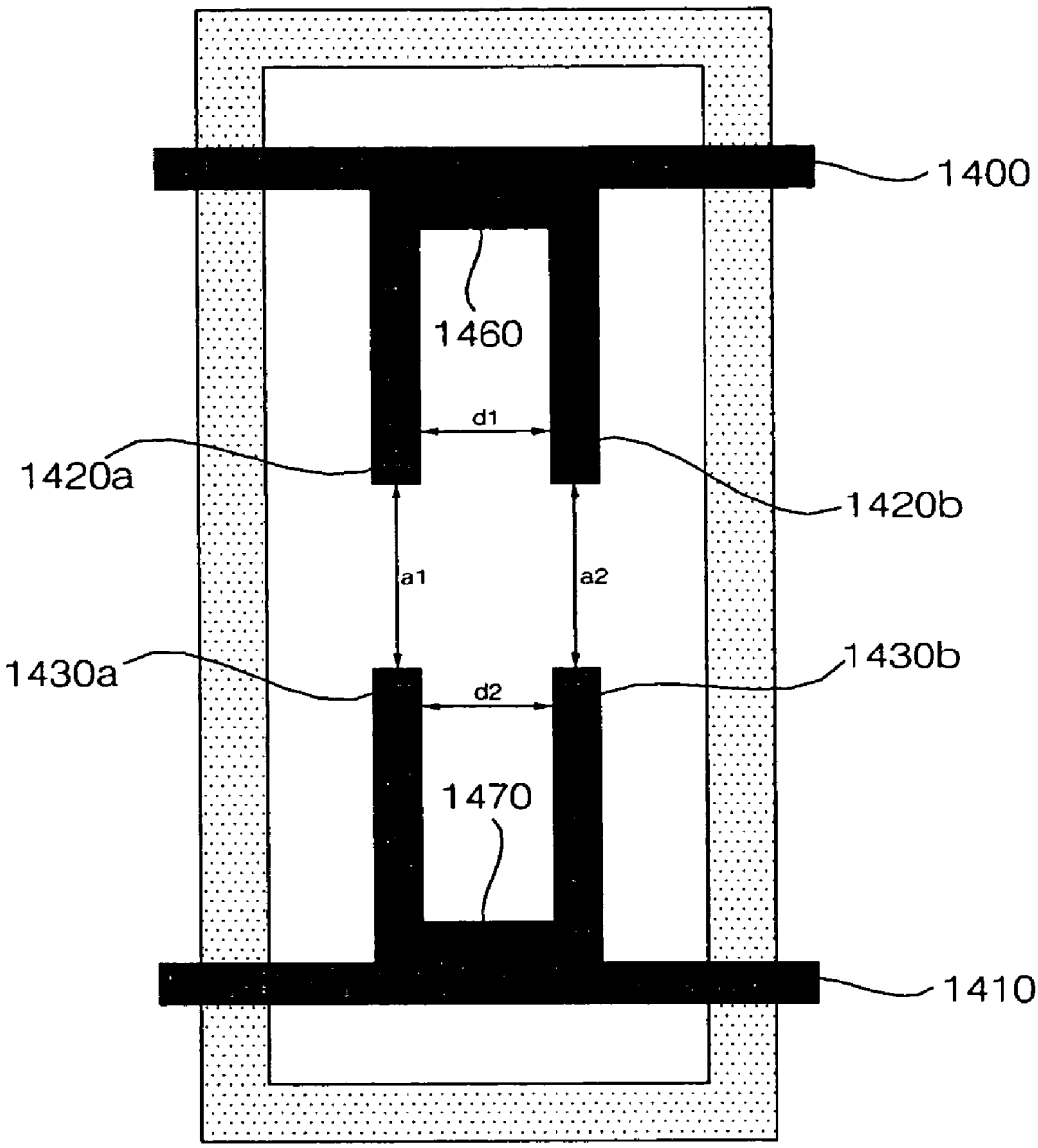

FIG. 15A and FIG. 15B are a cross-periodal view showing an eleventh embodiment of a sustain electrode structure, which forms a first projecting electrode 1420*a*, 1420*b*, 1420*c*, 1420*d*, protruded in the direction of the center of the discharge cell for each electrode line 1400, 1410, and a second projecting electrode 1440, 1450, 1460, 1470 protruded in the direction of the center of the discharge cell or in the opposite direction of the center of the discharge cell.

As shown in FIG. 15A, the first projecting electrode 1420*a*, 1420*b*, 1430*a*, 1430*b* comprising two electrodes is protruded in the direction of the center of the discharge cell for each electrode line 1400, 1410. The second projecting electrode 1440, 1450 comprising one electrode is protruded in the opposite direction of the center of the discharge cell. In other words, as shown in FIG. 15B, the second projecting electrode 1460, 1470 can be protruded in the direction of the center of the discharge cell.

It is preferable that the thickness of electrode lines 1300, 1310 of the sustain electrode pair ranges from 3 μm to 7 μm. As the description on the critical meaning of the upper and the lower value of the thickness of the electrode line is identical with the description illustrated with reference to FIG. 2, it will be omitted.

It is preferable that the width W1, W2 of projecting electrodes 1320, 1330 ranges from 35 μm to 45 μm. As the description on the critical meaning of the upper and the lower value of the width W1, W2 of the projecting electrode 1320, 1330 is identical with the description illustrated with reference to FIG. 12, it will be omitted.

It is preferable that the width of the first projecting electrode 1420*a*, 1420*b*, 1420*c*, 1420*d* ranges from 35 μm to 45 μm. As the description on the critical meaning of the upper and the lower value of the width of the projecting electrodes is identical with the description illustrated with reference to FIG. 5, it will be omitted.

It is preferable that the gap d1, d2 between the first projecting electrode comprising two electrodes protruded from one electrode line ranges from 50 μm to 100 μm when the plasma display panel has the size of 42 inch and the resolution of VGA. It is preferable that the gap ranges from 50 μm to 100 μm when the plasma display panel has the size of 42 inch and the resolution of XGA. It is preferable that the gap ranges from 40 μm or 90 μm when the plasma display panel has the size of 50 inch and the resolution of XGA. As the description on the critical meaning of the upper and the lower value of the gap d1, d2 of the first projecting electrode is identical with the description illustrated with reference to FIG. 7, it will be omitted.

It is preferable that the gap of the other first projecting electrode, that is, the gap al between 1420*a* and 1430*b*, or the gap a2 between 1420*a* and 1430*b* ranges from 15 μm to 165 μm. As the description on the critical meaning of the upper and the lower value of the gap of the projecting electrode is identical with the description illustrated with reference to FIG. 5, it will be omitted.

Figure 16:
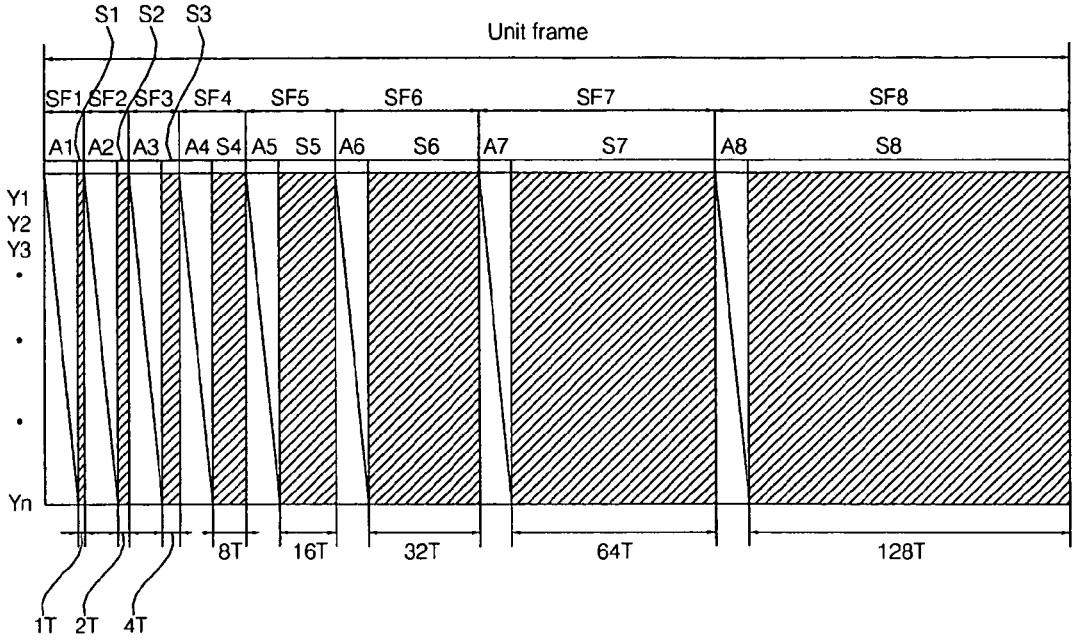
FIG. 16 is a timing diagram showing an embodiment of a method of time divided driving for a plasma display panel with dividing one frame into a plurality of subfields.

FIG. 16 is a timing diagram showing an embodiment of a method of time divided driving for a plasma display panel having the structure deccribed above according to the present invention with dividing one frame into a plurality of subfields. The unit frame can be divided into a predetermined number, for example, eight subfield SF1, . . . SF8 in order to realize a time-divided gray scale display. Further, each subfield SF1, . . . , SF8 is divided into a reset period(not shown), an address period A1, . . . , A8, and a sustain period S1, . . . , S8. Here, according to the embodiment of the present invention, the reset period can be omitted in at least one subfield among a plurality of subfields. For example, the reset period may just only exist in the first subfield, or may exist in an intermediate subfield between the first subfield and the total subfield.

In each address period A1, . . . , A8, the display data signal is applied to the address electrode X, while the scan pulse corresponding to each scan electrode Y is sequentially applied.

In each sustain period S1, . . . , S8, the sustain pulse is alternately applied to the scan electrode Y and the sustain electrode Z so that the sustain discharge is generated in the discharge cells where wall charges are formed in the address period A1, . . . , A8.

The luminance of the plasma display panel is in proportion to the number of the sustain discharge pulse of the sustain discharge period S1, . . . , S8 in the unit frame. When one frame forming one image is expressed with eight subfields and 256 gray scales, the different number of the sustain pulse can be sequentially allocated to each subfield at the rate of 1, 2, 4, 8, 16, 32, 64, 128. In order to obtain the luminance of 133 gray scales, the cells are addressed during subfield 1 period, subfield 3 period, and subfield 8 period to perform a sustain discharge.

According to the weight of the subfields by the automatic power control APC step, the sustain discharge number allocated to each subfield can be determined as a variable. That is, in FIG. 9, for example, the case of dividing a frame into 8 subfields was illustrated, but the present invention is not restricted in such case. Hence, the number of the subfield forming one frame can be variously changed according to a design type. For example, one frame can be divided into below or over 8 subfields, such as 12 subfields or 16 subfields to drive a plasma display panel.

Further, it is possible that the sustain discharge number allocated to each subfield variously changes in consideration of the gamma characteristics or the panel characteristics. For example, the gray level allocated to subfield 4 can be lowered from 8 to 6, while the gray level allocated to 6 can be enhanced from 32 to 34.

Figure 17:
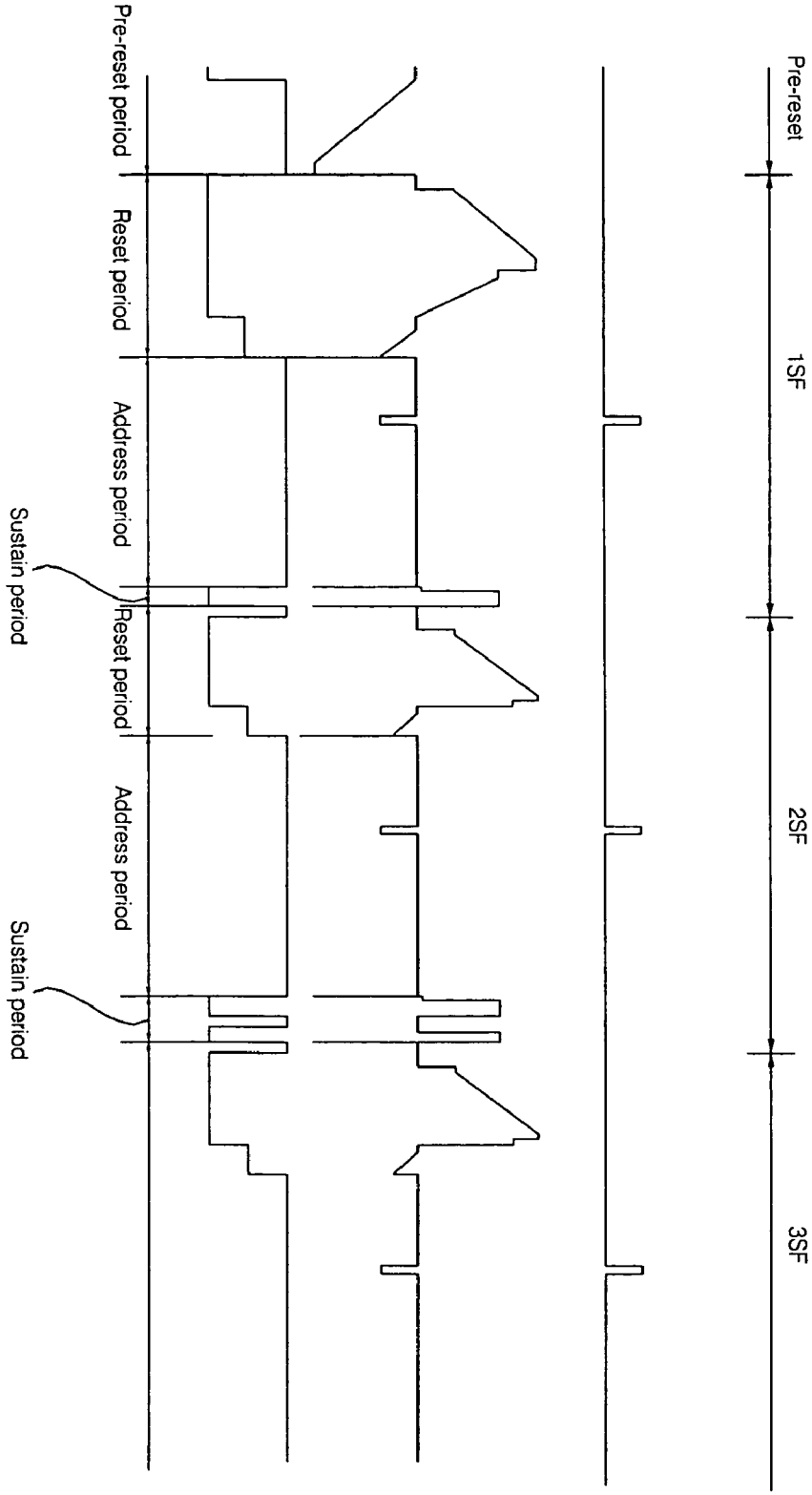
FIG. 17 is a timing diagram showing an embodiment of the driving signals for driving a plasma display panel.

FIG. 17 is a timing diagram showing an embodiment of the driving signals for driving a plasma display panel.

Firstly, a pre-reset period for forming positive wall charges on a scan electrode Y and forming negative wall charges on a sustain electrode Z exists. Then, by using the wall charge distribution formed by the pre-reset period, each subfield includes a reset period for initializing the discharge cells in the whole screen, an address period for selecting the discharge cell, and a sustain period for maintaining the discharge of the selected discharge cells.

The reset period is comprised of a set up period and a set down period. In the set up period, a ramp-up waveform is simultaneously applied to all the scan electrodes so that a micro-discharge is generated in all the discharge cells. Accordingly, the wall charges are generated. In the set down period, a ramp-down waveform descending from the positive voltage lower than the peak voltage of the ramp-up waveform is simultaneously applied to scan electrode Y so that the erasing discharge is generated in all the discharge cells. Accordingly, the wall charges generated by set-up discharge and the excessive charges of the space charges are erased.

In the address period, the scan signal scan of the negative polarity is sequentially applied to the scan electrode, at the same time, the data signal data of the positive polarity is applied to the address electrode X. The address discharge is generated to select a cell due to the voltage difference of the scan signal scan and the data signal data and the wall voltage generated during the reset period. In the meantime, during the set down period and the address period, the signal maintaining the sustain voltage Vs is applied to the sustain electrode.

In the sustain period, the sustain pulse is alternately applied to the scan electrode and the sustain electrode so that the sustain discharge is generated between the scan electrode and the sustain electrode as a surface discharge form.

As the drive waveforms shown in FIG. 17 is an embodiment of the signals for driving the plasma display panel according to the present invention, the present invention is not restricted by waveforms shown in FIG. 17. For example, the pre-reset period can be omitted. If necessary, the voltage level and the polarity of the driving signal can be changed. The erase signal for erasing the wall charge can be applied to the sustain electrode after the sustain discharge is completed. Further, a single sustain driving in which the sustain signal is applied to one of the scan electrode Y and the sustain electrode Z to generate the sustain discharge can be used.

According to the plasma display apparatus of the present invention, the transparent electrode consisting of Indium Tin Oxide ITO can be removed to reduce the manufacturing cost of the plasma display panel. Further, by forming projecting electrodes protruded in the direction of the center of the discharge cell or in the opposite direction of the center of the discharge cell from the scan electrode or the sustain electrode line, the firing voltage can be lowered and the discharge diffusion efficiency of the discharge cell can be increased.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display apparatus, comprising:

a front substrate;

a first electrode, a second electrode, and a dielectric layer formed on the front substrate;

a rear substrate positioned adjacent to the front substrate;

a third electrode formed on the rear substrate; and a plurality of row barrier ribs and a plurality of column barrier ribs formed on the rear substrate that partition discharge cells, wherein at least one of the first electrode or the second electrode is formed with one layer, wherein the first electrode or the second electrode in an area inside of an effective display region comprises at least two line portions formed in a direction intersecting with the third electrode, wherein the first electrode or the second electrode in an area outside of the effective display region comprises only one line portion, and wherein a width of the line portion in the area outside of the effective display region is wider than a width of each of the at least two line portions in the area inside of the effective display region, and wherein the line portion in the outside of the effective display region parallelly extends on the at least two line portions in the inside of the effective display region, and wherein a dummy cell divided by a dummy barrier rib includes the first electrode and the second electrode in the area outside of the effective display region.

2. The plasma display apparatus of claim 1, wherein the first electrode or the second electrode in the area inside of an effective display region further comprises at least one protrusion portion that protrudes from at least one of the at least two line portions.

3. The plasma display apparatus of claim 2, wherein a width between adjacent line portions of the at least two line portions is the same.

4. The plasma display panel of claim 2, wherein the at least one protrusion portion forms at least one closed loop.

5. The plasma display panel of claim 2, wherein the at least one protrusion portion extends toward a center of the respective discharge cell.

6. The plasma display panel of claim 2, wherein a width of the at least one protrusion portion ranges from approximately 35 μm to approximately 45 μm.

7. The plasma display panel of claim 2, wherein the at least one protrusion portion comprises at least two protrusion portions, at least one first protrusion portion extending toward a center of the respective discharge cell and at least one second protrusion portion extending away from the center of the respective discharge cell.

8. The plasma display panel of claim 7, wherein the at least one second protrusion portion extends toward a barrier rib of the respective discharge cell leaving a gap therebetween, wherein the gap is approximately 70 μm or less.

9. The plasma display panel of claim 2, wherein a length of the at least one protrusion portion ranges from approximately 50 μm to approximately 100 μm.

10. The plasma display panel of claim 2, wherein the at least one protrusion portion comprises a plurality of protrusion portions that extend toward a center of the respective discharge cell.

11. The plasma display panel of claim 2, wherein a central longitudinal axis of the at least one protrusion portion extends parallel to a central longitudinal axis of the at least one line portion.

12. The plasma display panel of claim 2, wherein the one layer comprises an opaque metal.

13. The plasma display panel of claim 2, wherein the one layer comprises one of silver, copper, or chrome.

14. The plasma display apparatus of claim 1, wherein a width of row barrier ribs in the area outside of the effective display region is wider than a width of row barrier ribs in the area inside of the effective display region, and wherein a width of column barrier ribs in the area outside of the effective display region is wider than a width of column barrier ribs in the area inside of the effective display region.

15. The plasma display apparatus of claim 14, wherein the width of the row barrier ribs in the area outside of the effective display region is approximately 1.25 times to approximately 4.5 times the width of the row barrier ribs in the area inside of the effective display region, and wherein the width of the column barrier ribs in the area outside of the effective display region is approximately 1.25 times to approximately 4.5 times the width of the column barrier ribs in the area inside of the effective display region.

16. The plasma display apparatus of claim 1, wherein the dummy cell includes a dummy electrode, and wherein the dummy electrode is formed having a shape which is identical with one of the first electrode and the second electrode.

17. The plasma display apparatus of claim 16, wherein the dummy electrode comprises:

at least one line portion formed in a direction intersecting with the third electrode; and at least one protrusion portion that protrudes from the at least one line portion.

18. The plasma display apparatus of claim 16, wherein a width of the dummy electrode ranges from approximately 30 μm to approximately 60 μm.

19. The plasma display apparatus of claim 1, wherein two or more dummy cells include a dummy line extending in a direction intersecting with the third electrode.

20. The plasma display apparatus of claim 19, wherein a number of the dummy lines formed on one side of the plasma display apparatus is two.

21. The plasma display apparatus of claim 1, wherein at least one of the first electrode and the second electrode is darker than the dielectric layer.

22. The plasma display apparatus of claim 1, wherein the rear substrate further comprises:

a dielectric layer; and a phosphor layer.

23. The plasma display panel of claim 1, wherein the first electrode and the second electrode comprise a plurality of first and second sustain electrodes, and the third electrode comprises a plurality of address electrodes.

24. The plasma display panel of claim 1, wherein a width of the first electrode and the second electrode ranges from approximately 30 μm to approximately 60 μm.

25. The plasma display apparatus of claim 1, wherein any one of Red (R), Green (G), and Blue (B) phosphor layers in the discharge cells has at least one of a symmetrical or an asymmetrical structure.

26. The plasma display apparatus of claim 25, wherein a pitch of the R phosphor layer equals a pitch of the G phosphor layer and a pitch of the B phosphor layer, where the R, G, and B phosphor layers in the discharge cells have a symmetrical structure.

27. A plasma display apparatus, comprising:

a front substrate;

a first electrode, a second electrode, and a dielectric layer formed on the front substrate;

a rear substrate positioned adjacent to the front substrate;

a third electrode formed on the rear substrate; and a plurality of row barrier ribs and a plurality of column barrier ribs formed on the rear substrate that partition discharge cells, wherein at least one of the first electrode and the second electrode is formed with one layer and comprises a dummy cell in which an image is not displayed, wherein the first electrode or the second electrode in an area inside of an effective display region comprises at least two line portions formed in a direction intersecting with the third electrode, wherein the first electrode or the second electrode in an area outside of the effective display region comprises only one line portion, and wherein a width of the line portion in the area outside of the effective display region is wider than a width of each of the at least two line portions in the area inside of the effective display region, and wherein the line portion in the outside of the effective display region parallelly extends on the at least two line portions in the inside of the effective display region, and wherein the dummy cell divided by a dummy barrier rib includes the first electrode and the second electrode in the area outside of the effective display region.

28. The plasma display apparatus of claim 27, wherein the first electrode or the second electrode in the area inside of an effective display region further comprises at least one protrusion portion that protrudes from the at least two line portions.

29. The plasma display apparatus of claim 27, wherein a width of row barrier ribs in an area outside of an effective display region is wider than a width of row barrier ribs in an area inside of the effective display region, and wherein a width of column barrier ribs in the area outside of the effective display region is wider than a width of column barrier ribs in the area inside of the effective display region.

30. The plasma display panel of claim 27, wherein the first electrode and the second electrode comprise a plurality of first and second sustain electrodes, and the third electrode comprises a plurality of address electrodes.

31. A plasma display apparatus, comprising:

a front substrate;

a first electrode, a second electrode, and a dielectric layer formed on the front substrate;

a rear substrate positioned adjacent to the front substrate;

a third electrode formed on the rear substrate; and a plurality of row barrier ribs and a plurality of column barrier ribs formed on the rear substrate that partition discharge cells, wherein at least one of the first electrode and the second electrode is formed with one layer, wherein a width of the row barrier ribs and the column barrier ribs formed in an outermost portion of the rear substrate is wider than a width of the other barrier ribs, wherein the first electrode or the second electrode in an area inside of an effective display region comprises at least two line portions formed in a direction intersecting with the third electrode, wherein the first electrode or the second electrode in an area outside of the effective display region comprises only one line portion, and wherein a width of the line portion in the area outside of the effective display region is wider than a width of each of the at least two line portions in the inside of the effective display region, and wherein the line portion in the outside of the effective display region parallelly extends on the at least two line portions in the inside of the effective display region, and wherein a dummy cell divided by a dummy barrier rib includes the first electrode and the second electrode in the area outside of the effective display region.

32. The plasma display apparatus of claim 31, wherein the width of the row barrier ribs and the column barrier ribs formed in the outermost portion of the rear substrate ranges from approximately 500 μm to approximately 900 μm.

33. The plasma display panel of claim 31, wherein a gap between adjacent line portions of the at least two line portions ranges from approximately 80μm to approximately 120μm.

34. The plasma display panel of claim 31, wherein the at least two line portions are connected by at least one bridge portion.

35. The plasma display panel of claim 31, wherein the first electrode and the second electrode comprise a plurality of first and second sustain electrodes, and the third electrode comprises a plurality of address electrodes.

* * * * *